US011114803B2

(12) United States Patent
Laurx et al.

(10) Patent No.: US 11,114,803 B2
(45) Date of Patent: Sep. 7, 2021

(54) CONNECTOR SYSTEM WITH WAFERS

(71) Applicant: Molex, LLC, Lisle, IL (US)

(72) Inventors: John Laurx, Aurora, IL (US); Bratislav Kostic, Elmhurst, IL (US); David Brunker, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/879,788

(22) Filed: May 21, 2020

(65) Prior Publication Data

US 2020/0381872 A1 Dec. 3, 2020

Related U.S. Application Data

(60) Provisional application No. 62/855,287, filed on May 31, 2019.

(51) Int. Cl.

| | |
|---|---|
| ***H01R 13/648*** | (2006.01) |
| ***H01R 13/6587*** | (2011.01) |
| ***H01R 12/72*** | (2011.01) |
| ***H01R 13/6471*** | (2011.01) |
| ***H01R 13/518*** | (2006.01) |
| ***H01R 12/71*** | (2011.01) |

(52) U.S. Cl.

CPC ..... *H01R 13/6587* (2013.01); *H01R 12/716* (2013.01); *H01R 12/727* (2013.01); *H01R 13/518* (2013.01); *H01R 13/6471* (2013.01)

(58) Field of Classification Search

CPC ..... H01R 12/716; H01R 12/727; H01R 13/6587; H01R 13/6471; H01R 13/518

USPC ..... 439/607.05–607.07

See application file for complete search history.

(56) References Cited

U.S. PATENT DOCUMENTS

| | | | | |
|---|---|---|---|---|
| 5,980,321 | A * | 11/1999 | Cohen | H01R 12/737 439/607.09 |
| 6,371,788 | B1 * | 4/2002 | Bowling | H01R 13/518 439/358 |
| 10,944,215 | B2 * | 3/2021 | Chua | H01R 13/6471 |
| 2014/0308827 | A1 | 10/2014 | Regnier | |
| 2014/0335735 | A1 | 11/2014 | Cohen et al. | |
| 2018/0219329 | A1 | 8/2018 | Morgan et al. | |

(Continued)

FOREIGN PATENT DOCUMENTS

| | | | |
|---|---|---|---|
| CN | 1200201 | A | 11/1998 |
| CN | 101371405 | A | 2/2009 |

(Continued)

*Primary Examiner* — Khiem M Nguyen

(57) ABSTRACT

The inventors describe various exemplary connectors and connector assemblies that allow for design flexibility and cost savings. Some embodiments of an electrical connector assembly include a housing member having a plurality of outer surfaces. They also include multiple wafers supported by the housing member, each wafer including a plurality of electrically conductive terminals and an insulative support member supporting the electrical terminals, each terminal having a contact configured to electrically connect the terminal to another electrical component. Some embodiments also include a satellite connector disposed along one of the outer surfaces of the housing member, the satellite connector including an insulative satellite housing and a plurality of connections supported by the satellite housing, each connection having a termination section, the termination section being operatively connected to a cable.

23 Claims, 20 Drawing Sheets

(56) References Cited

U.S. PATENT DOCUMENTS

| | | | | |
|---|---|---|---|---|
| 2020/0412061 | A1* | 12/2020 | Song | H01R 13/405 |
| 2021/0098939 | A1* | 4/2021 | Wu | H01R 13/518 |

FOREIGN PATENT DOCUMENTS

| | | | |
|---|---|---|---|
| CN | 104600449 | A | 5/2015 |
| CN | 105449461 | A | 3/2016 |
| CN | 103427197 | B | 6/2017 |
| TW | 201524014 | A | 6/2015 |
| TW | 201733225 | A | 9/2017 |

* cited by examiner

CONNECTOR SYSTEM WITH WAFERS

RELATED APPLICATIONS

This application claims priority to U.S. Provisional Application No. 62/855,287 filed on May 31, 2019, which is incorporated herein by reference in its entirety.

TECHNICAL FIELD

The present disclosure relates generally to electrical connectors and, more specifically, to electrical connectors including wafer assemblies that are used to interconnect orthogonal circuit members.

BACKGROUND

Electrical connectors are typically designed to meet both mechanical and electrical requirements. High speed or high data rate electrical connectors are often used in backplane applications that require very high density and high data rates. In order to achieve the desired mechanical and electrical requirements, such backplane connectors often utilize or incorporate wafer assemblies having an insulative web that supports a plurality of electrically conductive terminals. The use of wafer assemblies is often desirable to create a structure capable of achieving the desired high data rate that is also robust enough to support the desired assembly processes. The wafer assemblies are typically oriented to be perpendicular to the plane of the circuit board on which the backplane connector is mounted.

Backplane connectors may be provided to be used in any of a variety of different configurations. In a right angle mezzanine configuration, a mating pair of connectors is mounted on two parallel (and often co-planar) circuit boards or members. In such a mezzanine configuration, additional electrical connections may be made between the two circuit boards by either adding additional mating connectors in an adjacent configuration or by using connectors having a greater number of wafer assemblies.

In an orthogonal configuration, right angle backplane connectors are used to electrically connect two circuit boards or members that are orthogonal to each other. This results in the connectors being rotated by 90 degrees relative to each other. As a result, the number of rows and columns of each connector is limited as the rows and columns of one connector must match the columns and rows of the other connector. Adding additional electrical connections to orthogonal backplane connectors requires increasing the number of wafer assemblies of one of the connectors and increasing the height of the wafer assemblies of the other connector. However, modifying the tooling used to form the wafer assemblies or creating new tooling to change the number of terminals within a wafer assembly is typically very expensive.

Accordingly, it would be desirable to provide an orthogonal connector assembly in which the number of circuits or electrical connections may be readily modified.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

The inventors describe various exemplary connectors and connector assemblies that allow for design flexibility and cost savings.

Some embodiments of an electrical connector assembly may comprise: a housing member, the housing member having a plurality of outer surfaces; a plurality of wafers supported by the housing member, each wafer including a plurality of electrically conductive terminals and an insulative support member supporting the electrical terminals, each terminal having a contact configured to electrically connect the terminal to another electrical component; and a satellite connector disposed along one of the outer surfaces of the housing member, the satellite connector including an insulative satellite housing and a plurality of connections supported by the satellite housing, each connection having a termination section, the termination section being operatively connected to a cable.

In some embodiments, the wafers are parallel and oriented in a first direction and the plurality of connections of the satellite connector lie in a plane oriented perpendicular to the plurality of wafers.

In some embodiments, the connections of the satellite connector comprise electrically conductive terminals.

In some embodiments, the termination sections of the connections are disposed along a rear surface of the satellite housing.

In some embodiments, the termination sections of the connections of the satellite connector are terminated to a conductive member.

In some embodiments, the conductive member is a cable having a plurality of electrically conductive wires, each wire being terminated to the termination section of one of the connections.

In some embodiments, the conductive member is a flexible circuit member having a plurality of electrical conductors, each conductor being terminated to the termination section of one of the terminals.

In some embodiments, the wafers are generally planar and oriented in a side-by-side relationship and the satellite housing of the satellite connector is generally planar, the planes of the wafers being transverse to the plane of the satellite housing.

In some embodiments, the housing member includes first and second spaced apart sidewalls, and the wafers are parallel to the sidewalls.

In some embodiments, the plurality of wafers define a sub-assembly having a first end and an opposite second end, the first end being disposed adjacent the first side wall and the second end being adjacent the second sidewall.

In some embodiments, the wafers are disposed within the housing member.

In some embodiments, the satellite housing is a separate component from the housing.

In some embodiments, the wafers include a plurality of high speed signal terminals and a plurality of ground members.

In some embodiments, the terminals of the wafers include a mating section along a mating face and tails of the terminals are disposed along a board mount face, the mating face being perpendicular to the board mount face.

In some embodiments, the tails of the terminals comprise press fit pins.

In some embodiments, a portion of the housing member and a portion of the satellite housing define a shroud surrounding a mating section of the terminals of the wafers, the shroud being configured to operatively receive a mating electrical connector.

In some embodiments, the portion of the satellite housing defines an upper portion of the shroud.

In some embodiments, the connections of the satellite connector comprise at least one power terminal.

In some embodiments, the connections of the satellite connector comprise at least one optical fiber connector.

In some embodiments, the connections of the satellite connector comprise a plurality of high speed signal terminals and a plurality of ground members.

In some embodiments, the connections of the satellite connector comprise at least one electrically conductive low speed signal terminal.

In some embodiments the electrical connector assembly may further comprise: a second electrical connector assembly having a second housing member including a plurality of outer surfaces, a plurality of second wafers supported by the housing member, each wafer including a plurality of electrically conductive terminals and an insulative support member supporting the electrical terminals, each terminal having a contact configured to electrically connect the terminal to another electrical component; and a second satellite connector disposed along one of the outer surfaces of the second housing member, the second satellite connector including an insulative second satellite housing and a plurality of connections supported by the second satellite housing, each connection having a termination section, the termination section being operatively connected to the cable from the first satellite connector.

In some embodiments, the housing member has an upper surface, each terminal further has a tail configured to electrically connect the terminal to a circuit member, the tail of each terminal being disposed along a lower surface of the electrical connector, the upper surface being opposite the lower surface, and the satellite connector being disposed along the upper surface of the housing member.

Other embodiments of an electrical connector assembly may comprise: a housing member, the housing member including a first section and a second section, the first section being spaced from the second section; and a plurality of first wafers supported by the housing member within the first section of the housing member, each first wafer including a plurality of electrically conductive terminals and an insulative support member supporting the electrical terminals, each terminal having a contact configured to electrically connect the terminal to another electrical component and a tail configured to electrically connect the terminal to a circuit member, the tail of each terminal being disposed along a lower surface of the electrical connector; and at least one second wafer supported by the housing within the second section of the housing member.

In some embodiments, the housing member includes a spacer section between the first section and the second section.

In some embodiments, the spacer section is devoid of electrically conductive terminals.

In some embodiments the electrical connector assembly may further comprise at least one spacer wafer between first wafers and the at least one second wafer, the spacer wafer being devoid of operative terminals.

Other embodiments of an electrical connector assembly may comprise: a first electrical connector assembly having a first housing member, a plurality of first wafers supported by the housing member, each wafer including a plurality of electrically conductive terminals and an insulative support member supporting the electrical terminals, each terminal having a contact configured to electrically connect the terminal to another electrical component and a tail configured to electrically connect the terminal to a circuit member, the tail of each terminal being disposed along a lower surface of the electrical connector; a first satellite connector disposed along an outer surface of the first electrical connector, the first satellite connector including an insulative first satellite housing and a plurality of connections supported by the first satellite housing, each connection having a termination section, the termination section being operatively connected to a satellite cable; a second electrical connector assembly having a second housing member, a plurality of second wafers supported by the housing member, each wafer including a plurality of electrically conductive terminals and an insulative support member supporting the electrical terminals, each terminal having a contact configured to electrically connect the terminal to another electrical component and a tail configured to electrically connect the terminal to another member; and a second satellite connector disposed along an outer surface of the second electrical connector, the second satellite connector including an insulative second satellite housing and a plurality of connections supported by the second satellite housing, each connection having a termination section, the termination section being operatively connected to the satellite cable.

Yet other embodiments of an electrical connector assembly may comprise: a first electrical connector assembly having a first housing member, the first housing member supporting a plurality of electrically conductive first terminals, each first terminal having a contact; a first satellite connector disposed along an outer surface of the first electrical connector, the first satellite connector including an insulative first satellite housing and a plurality of first connections supported by the first satellite housing, each first connection having a mating section and a termination section, the termination section being operatively connected to a satellite cable; a second electrical connector assembly having a second housing member, the second housing member supporting a plurality of electrically conductive second terminals, each second terminal having a contact configured to mate with the second terminal to one of the contacts of the first terminals; and a second satellite connector disposed along an outer surface of the second electrical connector, the second satellite connector including an insulative second satellite housing and a plurality of second connections supported by the second satellite housing, each second connection having a mating section and a termination section, the mating section of the second connection being configured to mate with the mating section of one of the first connections of the first satellite connector.

BRIEF DESCRIPTION OF THE DRAWINGS

The present disclosure is illustrated by way of example and not limited in the accompanying figures in which like reference numerals indicate similar elements and in which.

DETAILED DESCRIPTION

Figure 1:
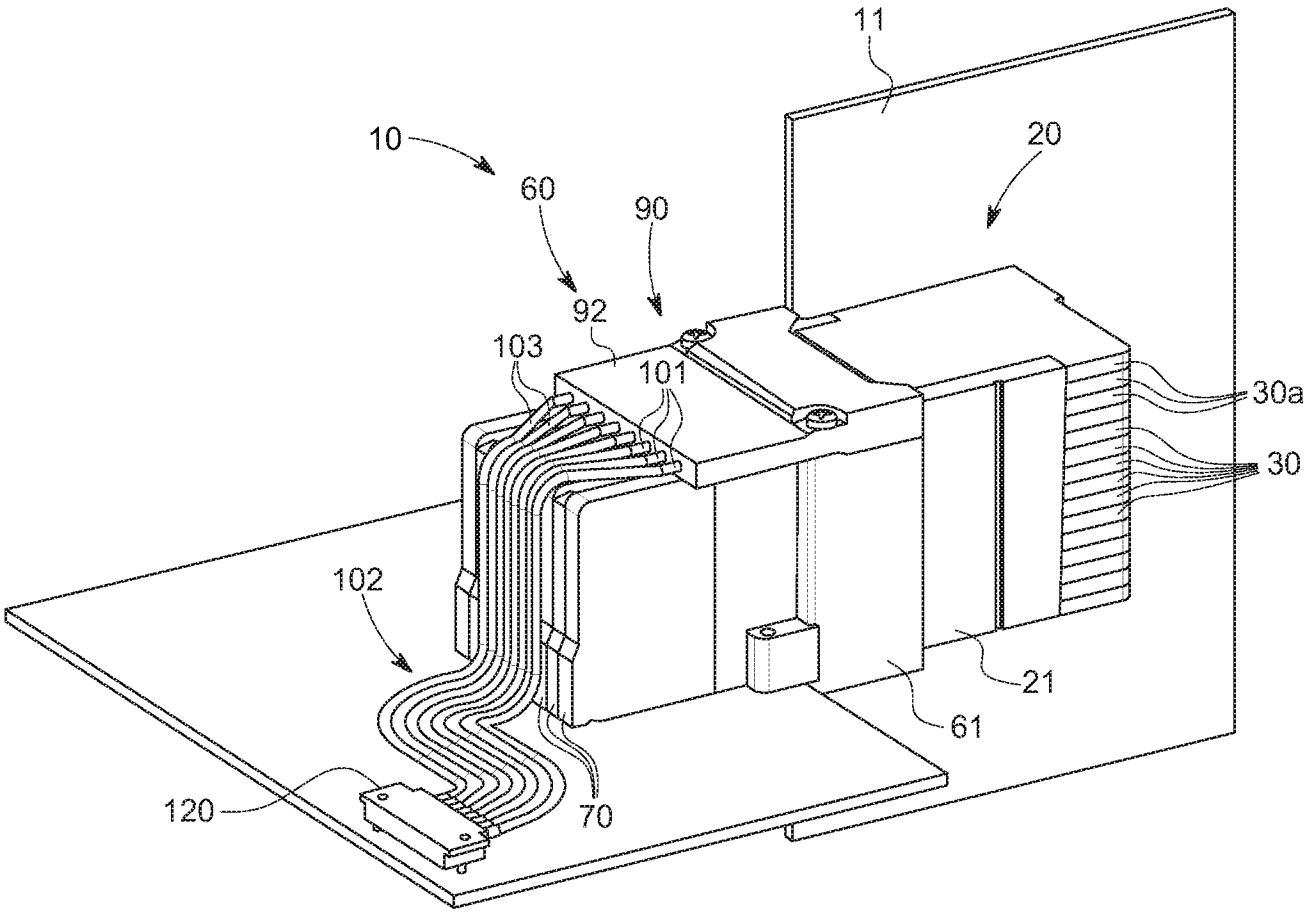
FIG. 1 is a perspective view of a connector system according to the present disclosure.
Figure 2:
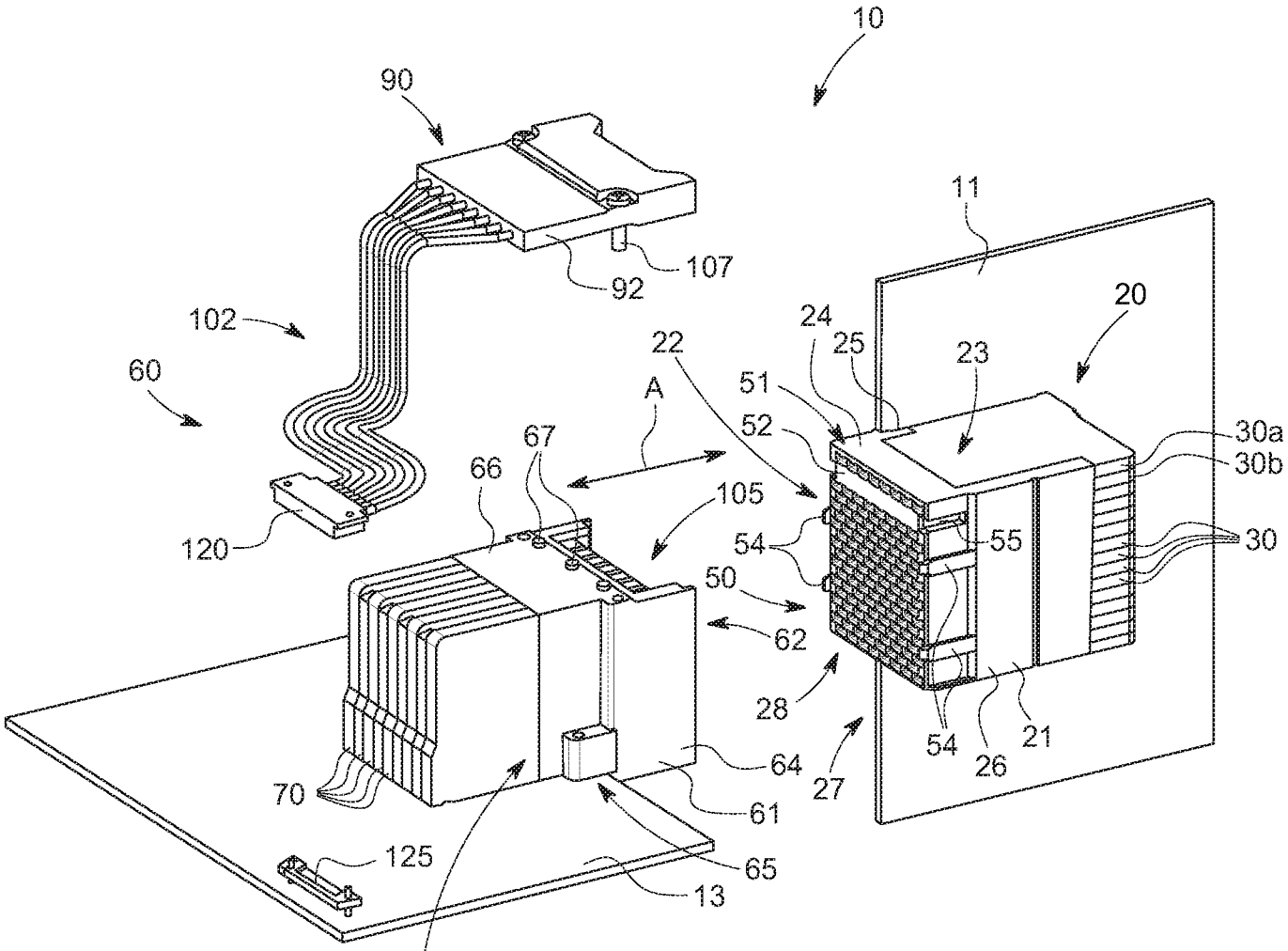
FIG. 2 is a perspective view of the connector system of FIG. 1 in an unmated condition with a satellite connector assembly exploded therefrom.

Referring to FIGS. 1-2, an orthogonal connector system 10 is depicted. The orthogonal connector system 10 includes a first right angle connector assembly 20 mounted on a first circuit member or board 11 and a second right angle connector assembly 60 mounted on a second circuit member or board 13. The first and second circuit boards 11, 13 are orthogonal to each other.

The first connector assembly 20 includes a first insulative housing 21 and a plurality of wafer assemblies 30. The first housing 21 has a front mating end or face 22, an opposite rear or wafer insertion end or face 23, sidewalls 24, a board-mount end or surface 25, and an opposite upper end or surface 26. Portions of the mating face 22, sidewalls 24, and board-mount surface 25 define a mating interface section 27 configured to be received within a receptacle or shroud 105 of the second connector assembly 60.

The front mating face 22 may include a plurality of openings or bores 28 that are configured to receive mating terminals from the second connector assembly 60 upon mating the two connector assemblies together. The wafer insertion end 23 may be open to facilitate the insertion of the plurality of wafer assemblies 30 into the housing 21. The housing 21 may be open along the board-mount surface 25 other than adjacent the mating interface section 27. The length of the sidewalls 24, the board mount surface 25, and the upper surface 26 may not be the same. For example, in some embodiments, the sidewalls 24 may be shorter (in the mating direction "A" in FIG. 2) than the upper surface 26.

Figure 3:
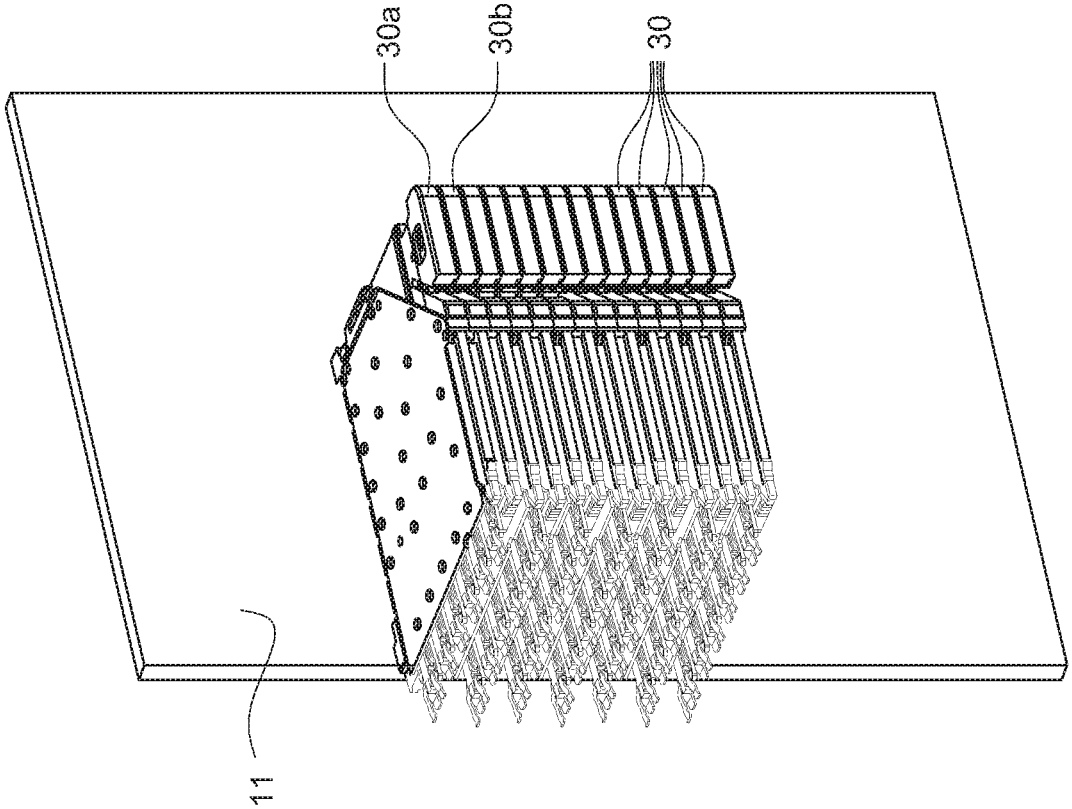
FIG. 3 is a perspective view of one of the connector assemblies of FIG. 1 with the housing component exploded therefrom.
Figure 3:
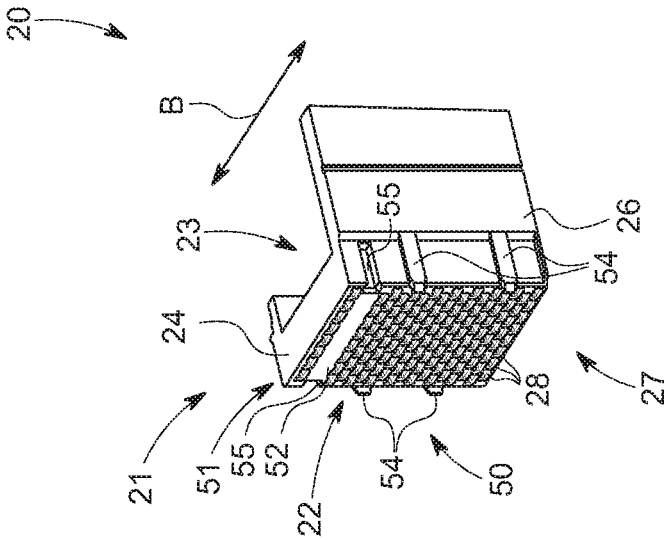
Figure 4:
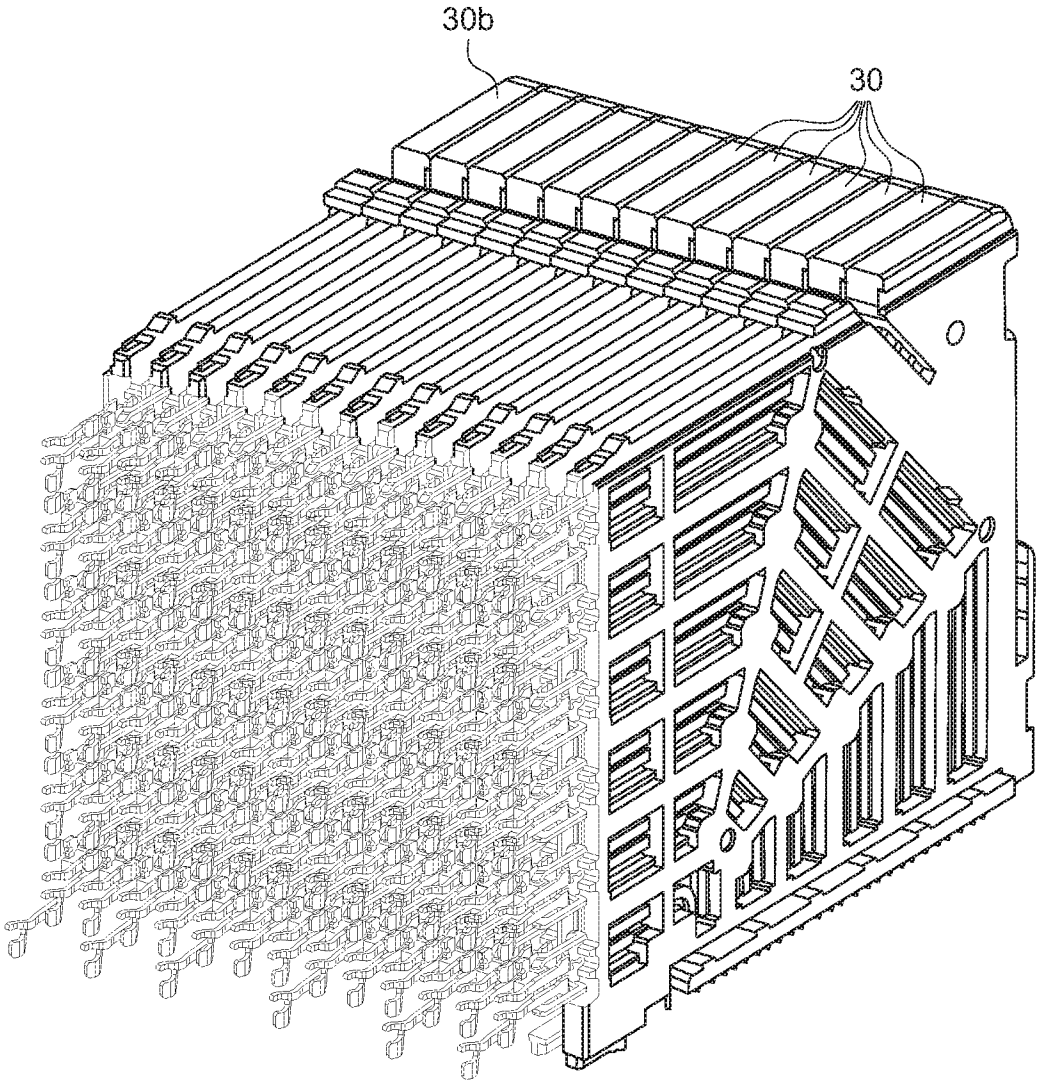
FIG. 4 is a perspective view of a subassembly of wafer assemblies of the connector assembly of FIG. 3 with one of the wafer assemblies exploded therefrom.
Figure 4:
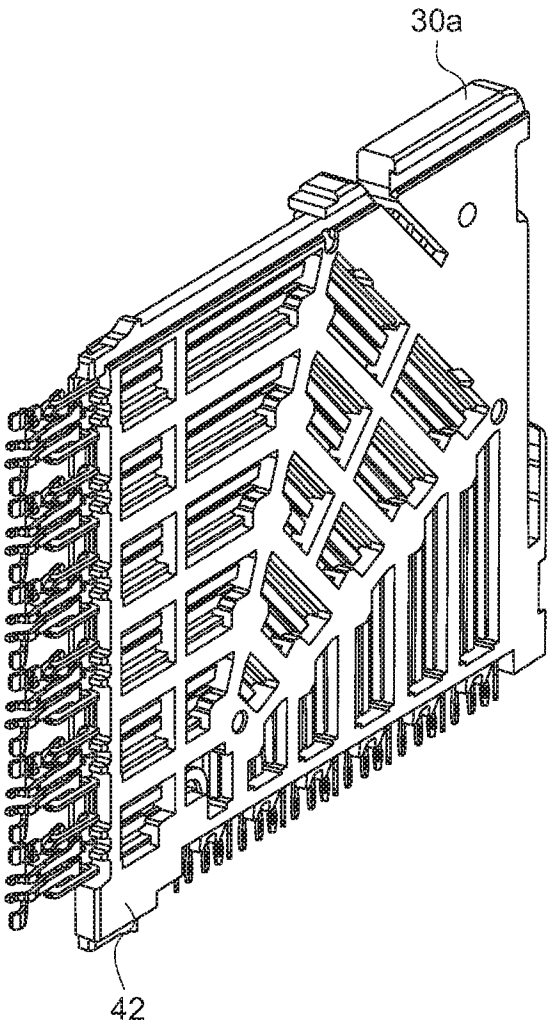
Figure 5:
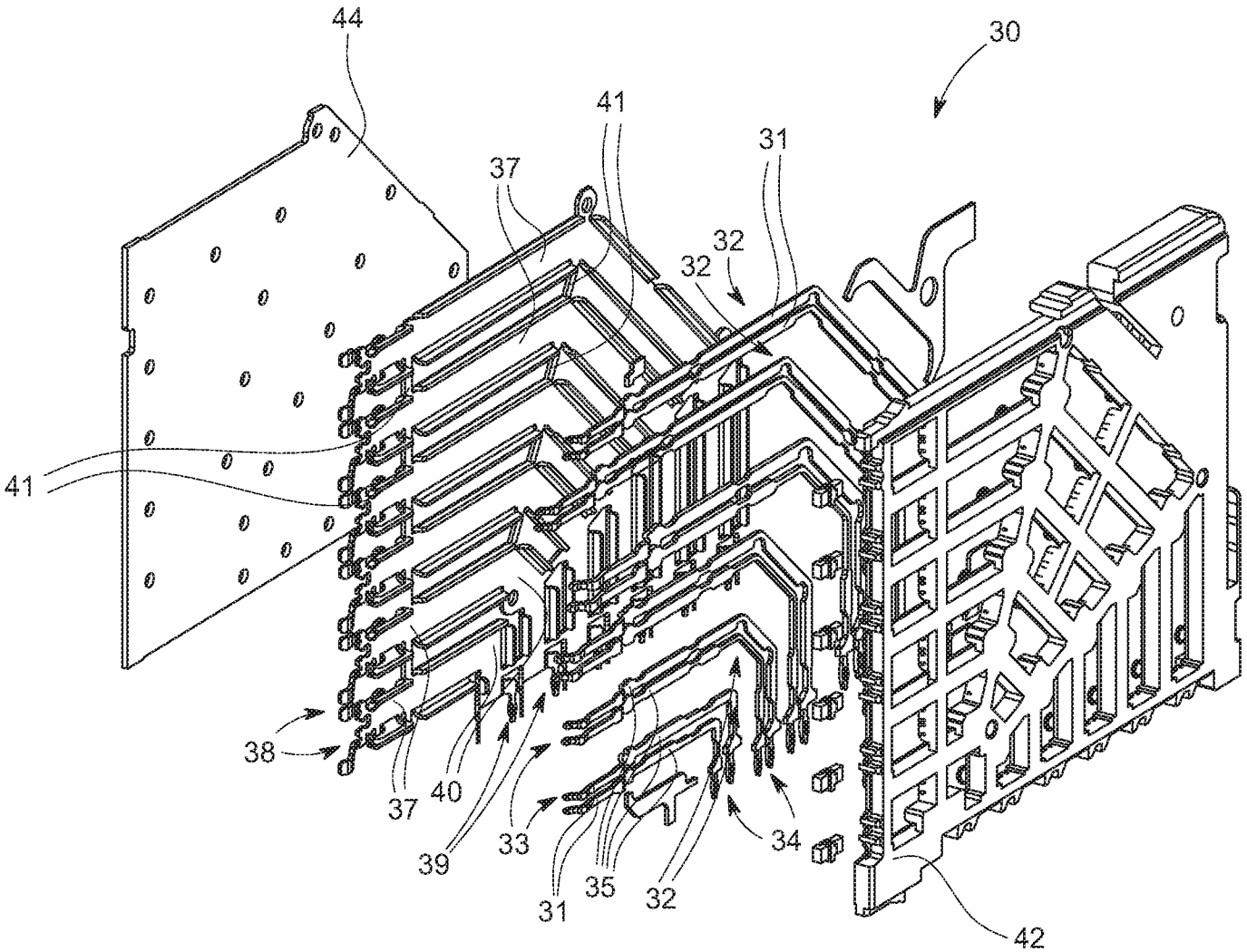
FIG. 5 is an exploded perspective view of one of the wafer assemblies of FIG. 4.

The wafer assemblies 30 of the first connector assembly 20 may have any desired configuration. Referring to FIGS. 3-5, an exemplary embodiment of the plurality of wafer assemblies 30 is depicted. The group of wafer assemblies 30 includes a plurality of parallel wafer assemblies, with each being perpendicular to the first circuit board 11. As depicted in FIG. 5, each wafer assembly 30 includes a plurality of high speed signal terminals 31, a plurality of ground or reference members 37, an insulative housing member or wafer 42, and a generally planar ground or reference plate 44. In certain applications, the high speed signal terminals could be re-purposed to provide power.

The high speed signal terminals 31 may be arranged as adjacent pairs 32 with a relatively small amount of vertical spacing between adjacent terminals of each pair and a relatively large amount of vertical spacing between adjacent pairs. As used herein, the word "vertical" with respect to the first connector assembly 20 refers to a direction perpendicular to the plane of the first circuit board 11 as depicted in FIGS. 1-2 and the word "horizontal" with respect to the first connector assembly refers to a direction parallel to the plane of the first circuit board.

Each signal terminal 31 has a mating end 33 configured to mate with a high speed signal terminal 71 of the second connector assembly 60 and a mounting tail 34 configured to be electrically connected to the first circuit board 11. In an embodiment, the mounting tails 34 may be configured as press-fit pins that mechanically engage plated holes in the first circuit board 11. The body portion 35 of each signal terminal 31 between the mating end 33 and the mounting tail 34 is configured to change direction so that the first connector assembly 20 may be configured as a right angle connector.

As depicted, each ground member 37 has a mating end 38 configured to mate with a ground terminal or member 77 of the second connector assembly 60 and a mounting tail 39 configured to be electrically connected to the first circuit board 11. The body 40 of the ground member 37 extends between the mating end 38 and the mounting tail 39 and has a U-shaped cross section. The body 40 of each ground member 37 is positioned adjacent the body portions 35 of each pair 32 of signal terminals 31 so that the terminal pairs are positioned within the U-shaped cross-section of its adjacent ground member to provide shielding and the desired impedance. In some embodiments, the ground members 37 may be connected by conductive webs 41.

The insulative wafer 42 supports the pairs 32 of vertically aligned signal terminals 31 and, in an embodiment, may be insert-molded around portions of the signal terminals. The ground members 37 may then be secured or attached to the wafer 42 and the generally planar ground plate 44 such as by heat-staking.

Other configurations and other manners of forming the wafer assemblies 30 are contemplated. For example, in an embodiment, although the terminals 31 are depicted with edge-coupled signal pairs 32, the terminals may be configured as broad-side coupled terminal pairs with planar sections of the terminals of each pair being parallel to and adjacent each other. In an embodiment, each terminal of a terminal pair may be disposed within its own wafer and the wafers assembled together to create the terminal pairs. Further, the ground members may be disposed within their own wafer that is secured to the wafer(s) of the signal terminals to form the wafer assembly. In some embodiments, the ground members 37 and/or the ground plate 44 may be omitted.

As a result of the configuration of the first housing 21 and the wafer assemblies 30, additional terminals 31 may be readily added to the first connector assembly 20. More specifically, additional terminals 31 may be added by increasing the lateral width of the first connector assembly 20 or the distance between the sidewalls 24 (as depicted by arrow "B" in FIG. 3) and inserting additional wafer assemblies into the wafer insertion end 23 of the first housing. More specifically, first housing 21 may be formed with a modular mold (not shown) that permits the distance between the sidewalls 24 to be changed prior to the molding process. As a result, the number of terminals of the first connector assembly 20 can be modified by configuring the housing mold to permit a greater number of wafer assemblies to be inserted therein without the expense of modifying the tooling required to manufacture the wafer assemblies.

Referring to FIGS. 2-3, the first housing 21 includes a first section 50 and a second section 51. Each of the first and second sections 50, 51 includes a plurality of openings 28 in the mating face 22. The first section 50 may be spaced from the second section 51. As depicted, the first section 50 is spaced from the second section 51 in a direction parallel to or along the first circuit board 11. The first section 50 receives therein some but not all of the plurality of wafer assemblies 30. The second section 51 may receive therein one or more wafer assemblies 30*a*. As depicted, the second section 51 has one wafer 30*a* therein. Wafer assembly 30*a* within the second section 51 may or may not be identical to the other wafer assemblies 30 within the first section 50 and may be referenced herein separately or collectively with the other wafer assemblies based upon context. Alternate functionality may be supported or provided by assembly 30*a* such as power, an electrically modified wafer to support an alternate transmission impedance as compared to the other wafer assemblies 30, or even different a transmission media such as optical.

In an embodiment, a spacer section 52 having no openings may be disposed between the first and second sections 50, 51 of the first housing 21. In another embodiment, the spacer section (not shown) may include a plurality of openings similar to the openings 29 of the mating face 22 but without terminals. One or more spacer wafers 30*b* having no terminals (or at least having no mating sections) inserted therein may be positioned between the group of wafer assemblies 30 and the wafer assembly 30*a* and disposed within the spacer section 52. Through such a configuration, a plurality or stack of wafer assemblies 30, 30*a* and spacer wafers 30*a* may be assembled together to create a sub-assembly and then the sub-assembly inserted into the first housing 21 through the wafer insertion end 23.

Although depicted with the first housing 21 constructed as a unitarily molded, one-piece structure, the first housing may be formed of multiple components that are assembled together. For example, referring to FIG. 16, the first section 50 and the second section 351 of first connector assembly 320*b* may be portions of separate housing members that operate as a single housing member. The structure used to secure the separate housing members together may occupy some or all of the space of the spacing section 52.

Figure 6:
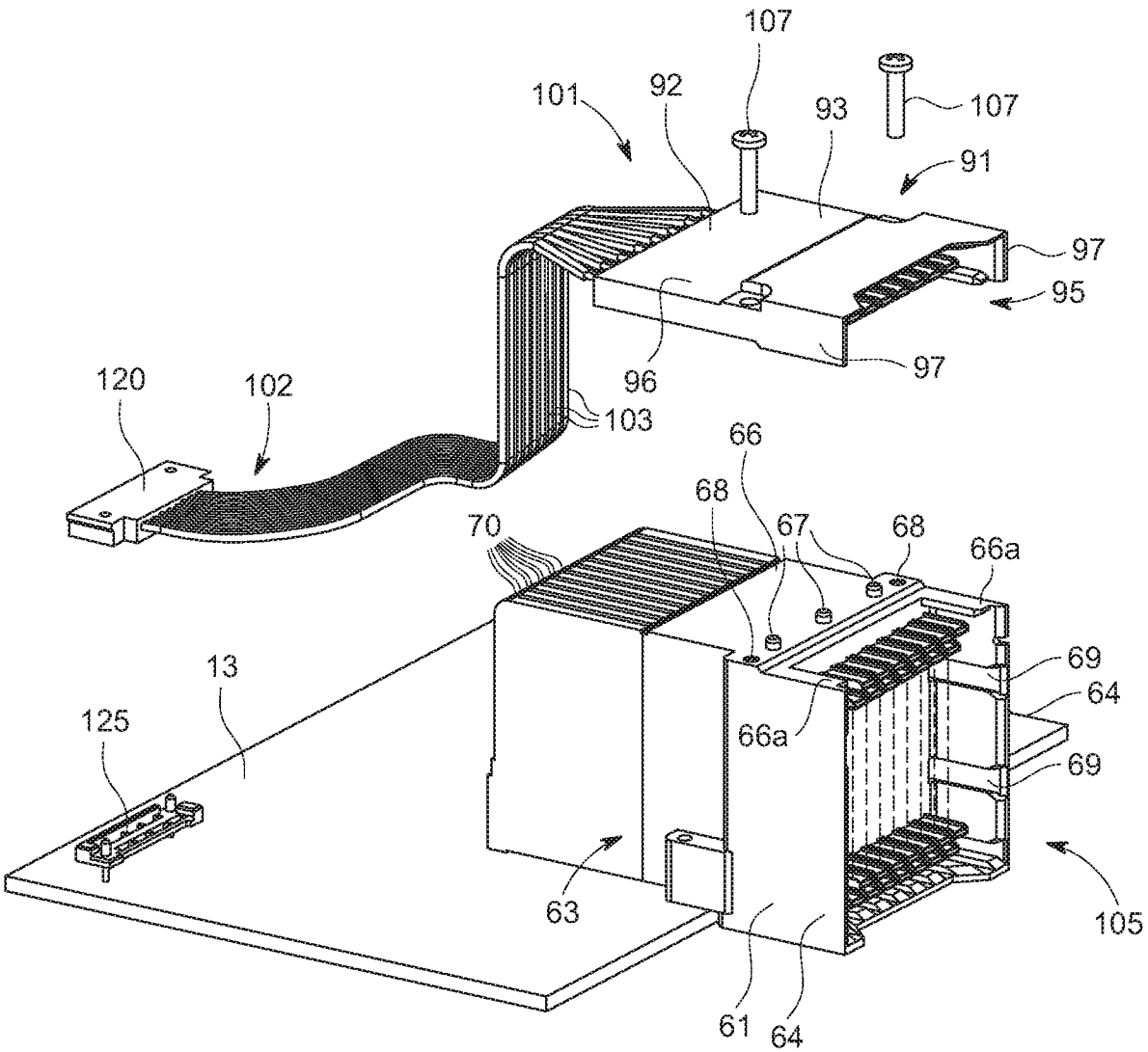
FIG. 6 is a perspective view of the other connector assembly of FIG. 1 with the satellite connector exploded therefrom.
Figure 7:
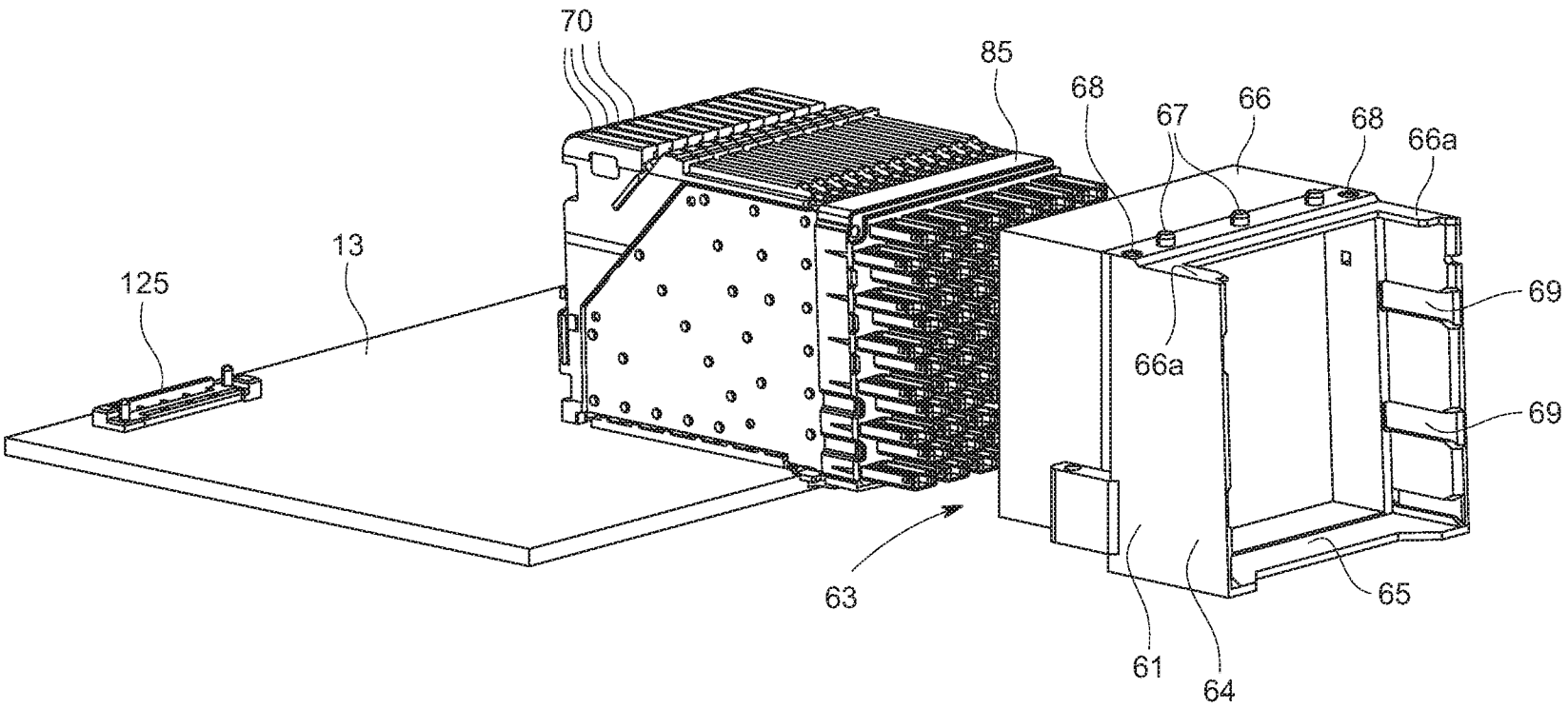
FIG. 7 is a perspective view of a portion of the connector assembly of FIG. 6 with the housing component exploded therefrom.

Referring to FIGS. 6-7, the second connector assembly 60 includes a second insulative housing 61, a plurality of wafer assemblies 70, a ground support member 85, and a satellite connector assembly 90. The second housing 61 has a front mating end or face 62, an opposite rear or wafer insertion end or face 63, sidewalls 64, a board-mount end or surface 65, and an opposite upper end or surface 66.

The mating sections of the terminals of the wafer assemblies 70 extend through ground support member 85 to facilitate mating with the high speed signal terminals 31 and ground members 37 of the first connector assembly 20. The wafer insertion end 63 may be open to facilitate the insertion of the plurality of wafer assemblies 70 into the second housing 61. The second housing 61 may be open along the board-mount surface 65 other than adjacent the mating end 62. The length of the sidewalls 64 and the upper surface 66 may not be the same.

Figure 8:
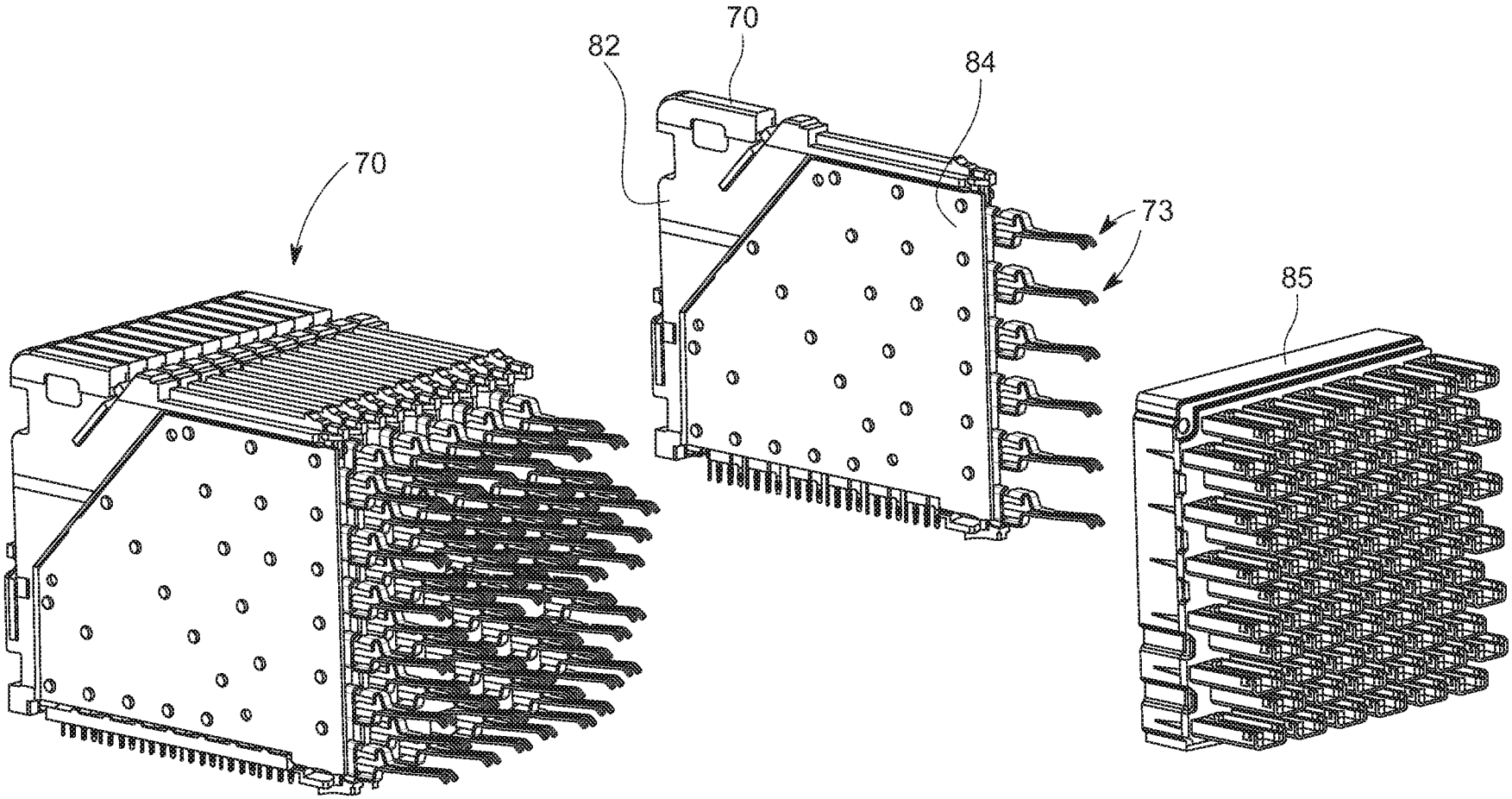
FIG. 8 is a perspective view of a subassembly of wafer assemblies of the connector assembly of FIG. 6 with the ground member and one of the wafer assemblies exploded therefrom.
Figure 9:
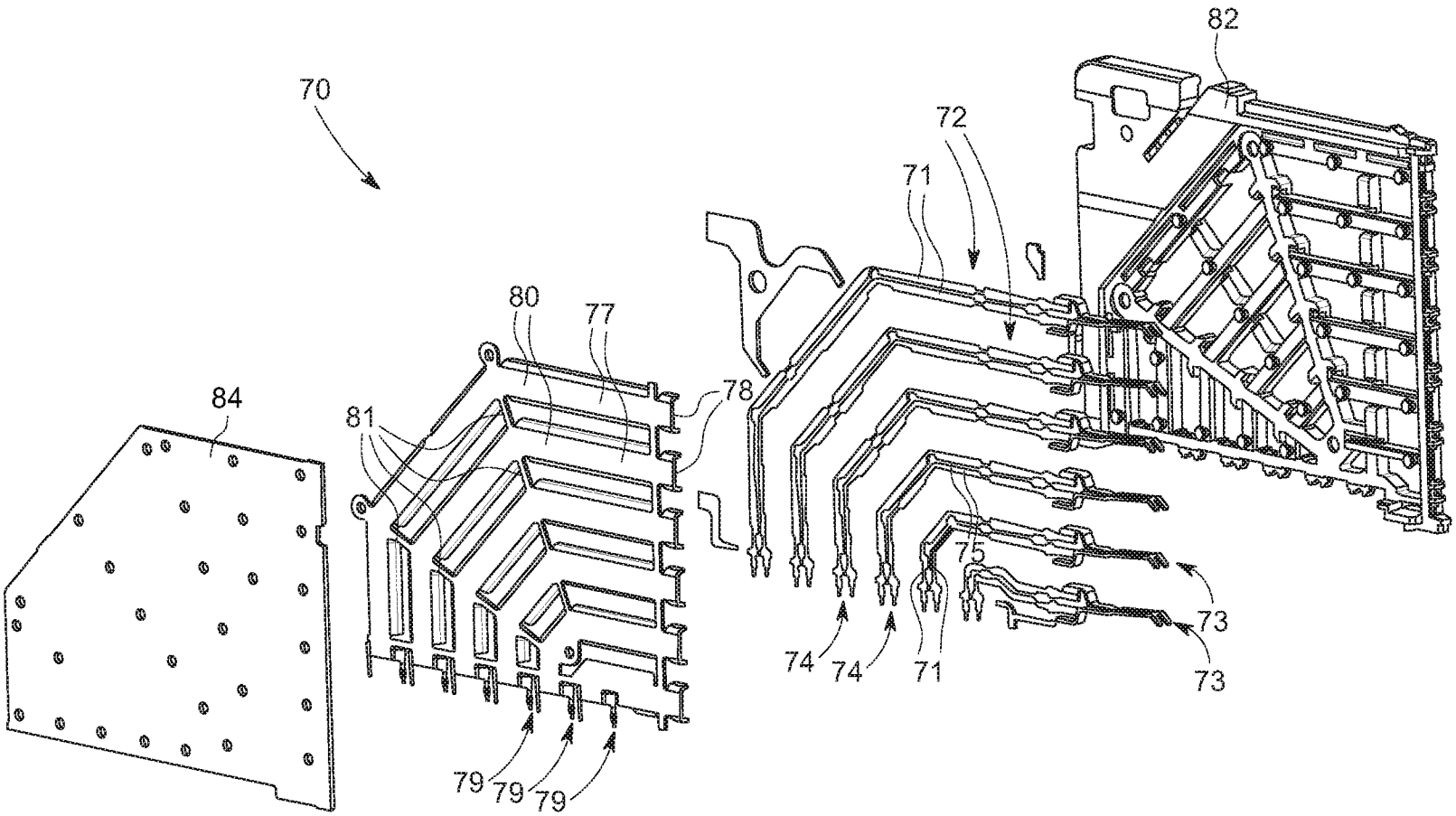
FIG. 9 is an exploded perspective view of one of the wafer assemblies of FIG. 8.

The wafer assemblies 70 of the second connector assembly 60 may be configured in a manner similar or identical to the wafer assemblies 30. Referring to FIGS. 7-9, an exemplary embodiment of the plurality of wafer assemblies 70 is depicted. The group of wafer assemblies 70 includes a plurality of parallel wafer assemblies, with each being perpendicular to the second circuit board 13. As depicted, each wafer assembly 70 includes a plurality of high speed signal terminals 71, a plurality of ground or reference members 77, an insulative housing member or wafer 82, and a generally planar ground or reference plate 84.

The high speed signal terminals 71 may be arranged as adjacent pairs 72 with a relatively small amount of vertical spacing between adjacent terminals of each pair and a relatively large amount of horizontal spacing between adjacent pairs. As used herein, the word "vertical" with respect to the second connector assembly 60 refers to a direction perpendicular to the plane of the second circuit board 13 as depicted in FIGS. 1-2 and the word "horizontal" with respect to the second connector assembly refers to a direction parallel to the plane of the second circuit board.

Each signal terminal 71 has a mating end 73 configured to mate with a high speed signal terminal 31 of the first connector assembly 20 and a mounting tail 74 configured to be electrically connected to the second circuit board 13. As described above, in an embodiment, the mounting tails 74 may be configured as press-fit pins that mechanically engage plated holes in the first circuit board 11. The body portion 75 of each signal terminal 71 between the mating end 73 and the mounting tail 74 is configured to change direction so that the second connector assembly 60 may be configured as a right angle connector.

As depicted, each ground member 77 has a mating end 78 configured to mate with a ground terminal or member 37 of the first connector assembly 20 and a mounting tail 79 configured to be electrically connected to the second circuit board 13. The body 80 of the ground member 77 extends between the mating end 78 and the mounting tail 79 and has a U-shaped cross section. The body 80 of each ground member 77 is positioned adjacent the body portions 75 of each pair 72 of signal terminals 71 so that the terminal pairs are positioned within the U-shaped cross-section of its adjacent ground member to provide shielding and the desired impedance. In some embodiments, the ground members 77 may be connected by conductive webs 81.

The insulative wafer 82 supports the pairs 72 of vertically aligned signal terminals 71 and, in an embodiment, may be insert-molded around portions of the signal terminals. The ground members 77 may then be secured or attached to the wafer 82 and the generally planar ground plate 84 such as by heat-staking.

In order to permit the first connector assembly 20 to be mated with the second connector assembly 60, the mating interface section 27 of the first connector assembly must be configured to be received within the shroud 105 of the second connector assembly. In addition, each of the first and second connector assemblies 20, 60 must also have the same configuration. More specifically, the same number of rows and columns of signal terminals 31, 71 and ground members 37, 77, the same spacing or pitch between the terminals and ground members, and the mating ends 33, 73 of the signal terminals and the mating ends 38, 78 of the ground members must also be configured to mate with each other.

While forming connector assemblies incorporating terminal wafers is desirable in some connector systems, utilizing terminal wafers in conjunction with orthogonal connector assemblies typically reduces the flexibility to modify the number of terminals that may be carried by each connector assembly. More specifically, while the distance between the sidewalls 24 of the first connector assembly 20 may typically be increased to permit the insertion of additional wafer assemblies 30, modifying the second connector assembly 60 to mate with such a modified first connector assembly would require increasing the height (i.e., parallel to the sidewalls 64 or perpendicular to the second circuit board 13) of the second housing 61 as well as the height of the wafer assemblies 70.

The second connector assembly 60 depicts a solution that does not require a modification of the wafer assemblies 70. The second connector assembly 60 includes one or more satellite connector assemblies 90 mounted on the upper surface 66 of the second housing 61 and forming the upper surface of the connector assembly 60. Referring to FIGS. 1, 2, and 6-7, in one embodiment, satellite connector assembly 90 includes a satellite connector 91 having a satellite housing 92 with a plurality of electrically conductive terminals 100 mounted therein, a flexible cable or circuit member 102 having a plurality of conductors 103, and a board-to-board electrical connector 120. The satellite housing 92 has a terminal retention body 93 and a mating section 95. The mating section 95 is configured as a generally inverted U-shape with a connecting structure or web 96 extending between a pair of spaced apart sidewalls 97.

The electrically conductive terminals 100 may have any configuration provided that they are configured to mate with the terminals of wafer assembly 30*a* of the first connector assembly 20. Accordingly, in the depicted embodiment, the terminals 100 include high speed signal terminals and ground or reference terminals in the same pattern as wafer assembly 30*a*. The terminals 100 including a mating section or end (not shown in FIG. 6) and a termination section or end 101. The termination end 101 of each terminal 100 is terminated to one of the conductors 103 of the cable 102. The conductors 103 of the cable 102 electrically connect at least some of the terminals 100 within the satellite housing 92 to at least some of the terminals (not shown) of the board-to-board electrical connector 120.

Upon mounting the satellite connector 91 on the second housing 61, portions of the sidewalls 64 of the second housing 61 may be aligned with the sidewalls 97 of the satellite housing 91. By reducing the length of the upper surface 66 of the second housing 61, portions of the sidewalls 64 and the board-mount surface 65 of the second housing 61 together with the satellite housing 92 define a shroud 105 configured to receive therein the mating interface section 27 of the first connector assembly 20.

Further, reducing the length of the upper surface 66 of the second housing 61 provides an opening to receive the spacer section 52 of the first housing 21. In an alternate embodiment, the upper surface 66 may extend the same (or some other) length as the sidewalls 64 and the board mount surface 65 towards the first connector assembly 20, and the spacer section 52 of the first housing 21 provided with a recess (not shown) that extends along the mating face 22 to accommodate the upper surface 66 of the second housing 61.

The upper surface 66 of the second housing 61 and the lower surface of the body 93 of the satellite housing 92 may include alignment structure or members to align the satellite housing 91 on the second housing. As depicted, the second housing 61 includes a plurality of projections or pegs 67 that are received within a like plurality of recesses or openings (not shown) in the lower surface of the body 93 of the satellite housing 92.

Connecting members or structure may be provided to secure the satellite housing 91 to the upper surface 66 of the second housing 61. Any type of connecting structure may be used. As depicted, fasteners 107, such as screws, may extend through the satellite housing 91 into threaded bores 68 in the second housing 61. Other connecting members or structure such as press-fit members or heat-staking are contemplated.

A board-mount electrical connector 125 may be mounted on the second circuit board 13 and configured to mate with the board-to-board electrical connector 120. Electrically conductive terminals (not shown) of the board-mount electrical connector 125 may be electrically connected to conductive traces (not shown) on or of the second circuit board 13.

If desired, some or all of the terminals 100 may be substituted with optical connections and corresponding elements of the cable 102, the board-to-board connector 120, and the board-mount connector 125 configured to transmit and receive optical signals.

During assembly, in an embodiment, the second connector assembly 60, without the satellite connector assembly 90, is mounted on the second circuit board 13 by applying a force to the upper surface 66 of the second housing 61 and/or the wafer assemblies 70 to force the mounting tails 74 of the high speed signal terminal 71 and the mounting tails 79 of the ground members 77 into aligned holes in the second circuit board. The satellite connector assembly 90 is mounted to the upper surface 66 of the second housing 61 and secured thereto. The board-to-board connector 120 may then be aligned with and mated to the board mount connector 125 that is previously mounted on the second circuit board 13. In other embodiments, it may be possible to mount the fully assembled second connector assembly 60, including the satellite connector assembly 90, to the second circuit board 13 so that the second connector assembly may be fully assembled prior to the mounting operation.

The first connector assembly 20 and the second connector assembly 60 may include alignment and/or guide structure to facilitate alignment and guiding of the two connector assemblies during mating. Any desired structure may be utilized. As depicted, the first connector assembly 20 includes two projections 54 along each sidewall 24 adjacent the first section 50 of the mating face 22 and a single recess or opening 55 along each sidewall adjacent the spacer section 52. The second connector assembly 60 includes two recesses or openings 69 along each sidewall 64 that are configured (e.g., dimensioned and aligned) so as to mate with the projections 54 of the first connector assembly 20 upon mating the first and second connector assemblies together. As depicted, the upper surface 66 of the second housing 61 is not completely removed adjacent the mating end of the second housing 61 to form a pair of inwardly extending projections 66*a*. The inwardly extending projections 66*a* are configured (e.g., dimensioned and aligned) so as to mate with the openings 55 along each sidewall 24 of the first housing 21 upon mating the first and second connector assemblies 20, 60 together.

Figure 10:
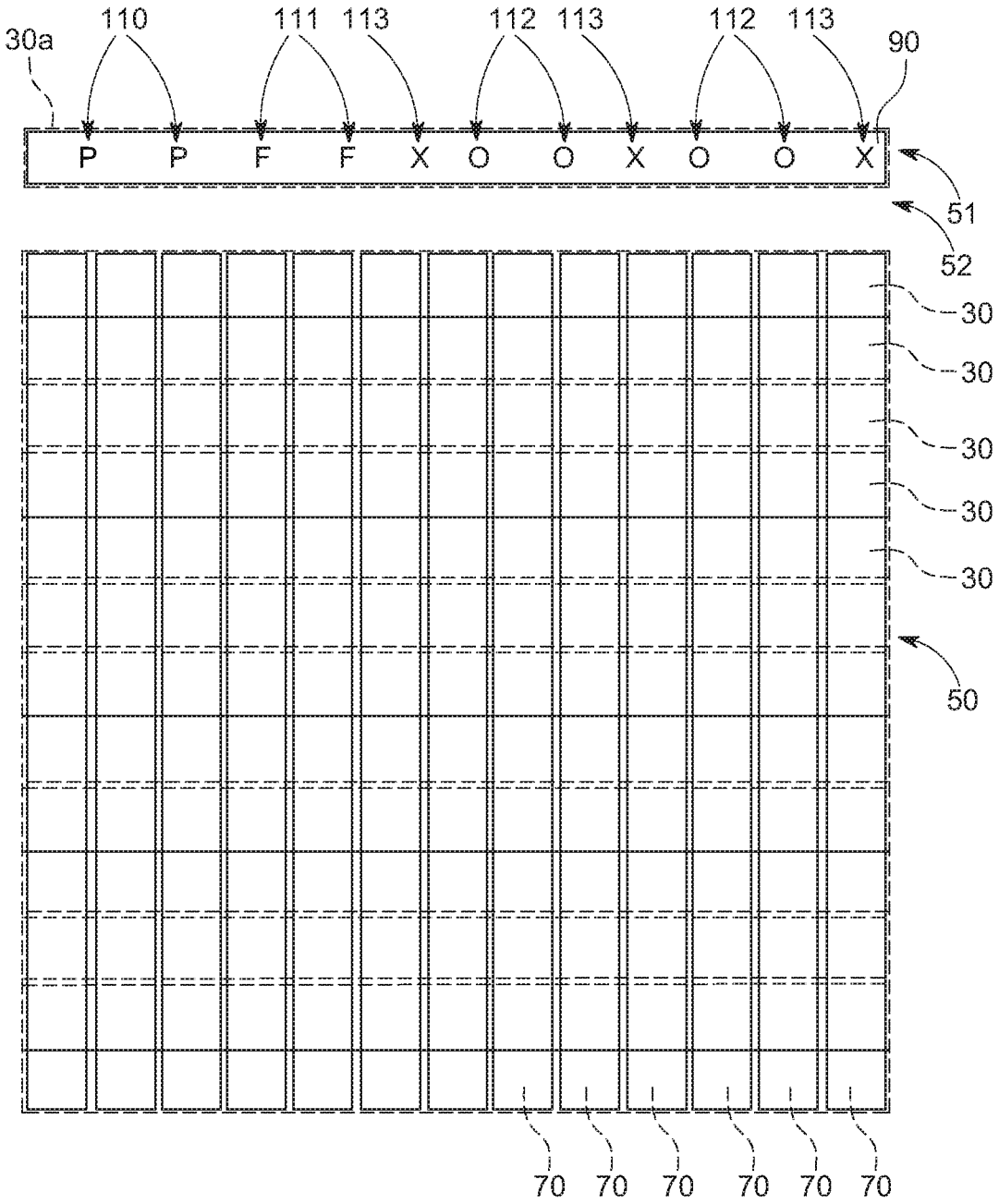
FIG. 10 is a schematic view showing the orientation of the wafers of the connector assembly of FIG. 3 and the wafers and satellite connector assembly of FIG. 6.

Reference is made to FIG. 10 in which the wafers assemblies 30 of the first connector assembly 20 are schematically depicted in dashed lines and the wafer assemblies 70 of the second connector assembly 60 are schematically depicted in solid lines. It may be seen that the upon mating the connector assembly 20 and the second connector assembly 60, the wafer assemblies 30 of the first connector assembly 20 are orthogonal to the wafer assemblies 70 of the second connector assembly 60. However, the satellite connector assembly 90 (depicted in solid lines) is perpendicular to the wafer assemblies 70 of the second connector assembly 60 and thus is parallel to the wafer assemblies 30 of the first connector assembly 20. As a result, there is a one-to-one correspondence between the wafer assembly 30*a* (depicted in dashed lines) of the second section 51 and the satellite connector assembly 90.

Through such a configuration, modifications to the terminals within the wafer assembly 30*a* and the satellite connector assembly 90 may be readily made without impacting the wafer assemblies 30 of the first section 50 and the wafer assemblies 70 of the second connector assembly 60. In other words, the wafer assembly 30*a* and the satellite connector assembly 90 may be configured in any manner without required corresponding changes to the wafer assemblies 30, 70. The independent nature of this pre-anticipated but post-design readily permits additions and modifications that provide for considerable flexibility in product configuration options including unique architectural solutions such as the addition of loop back and cross-connect features that might otherwise require possible redesign and re-tooling. In addition, the disclosed structure avoids or reduces the need for indirect solutions that could be sub-optimal in transmission loss and timing delay.

As a result of mating the connector assembly 20 and the second connector assembly 60, a plurality of electrical connections between the first circuit board 11 and the second circuit board 13 will be established. More specifically, electrical connections will be established from the first circuit board 11 through the high speed signal terminals 31 and the ground members 37 of the wafer assemblies 30 within the first section 50 of the first housing 21 of the first connector assembly 20 and then through the respective high speed signal terminals 71 and the ground members 77 of the wafer assemblies 70 of the second connector assembly 60 and to the second circuit board 13. In addition, the electrical connections from the first circuit board 11 are made through the wafer assembly 30*a* of the second section 51 of the first housing of the first connector assembly 20 and then through the terminals 92 of the satellite connector assembly 90, through the cable 93 to the board-to-board electrical connector 120. By connecting the board-to-board electrical connector 120 to the board mount connector 125, the electrical connection between the first circuit board 11 and the second circuit board 13 may be completed.

Figure 11:
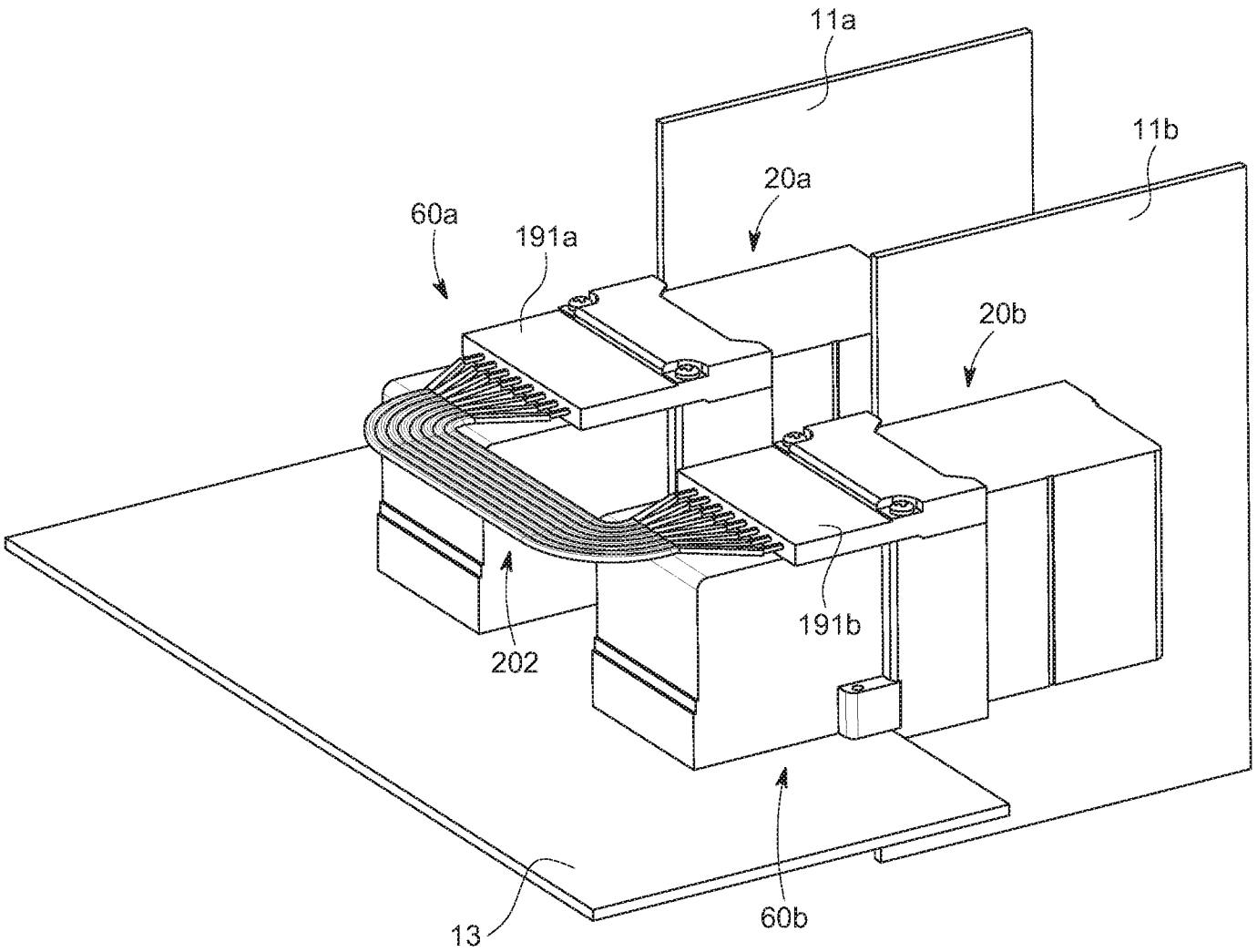
FIG. 11 is a perspective view of an alternate embodiment of a connector system according to the disclosure.
Figure 12:
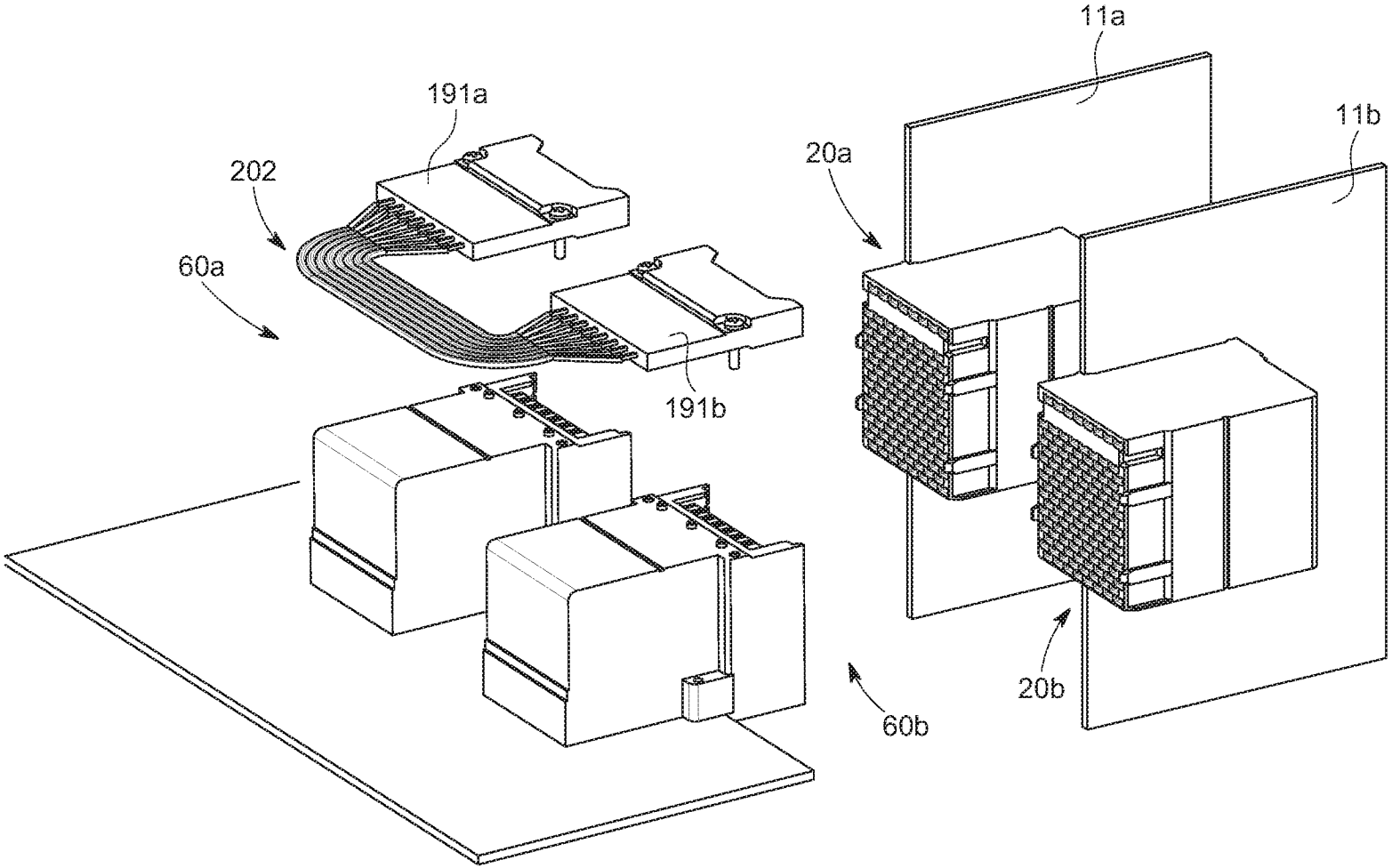
FIG. 12 is a perspective view of the connector system of FIG. 11 in an unmated condition with a satellite connector assembly exploded therefrom.

Various alternative configurations and uses are contemplated. For example, referring to FIGS. 11-12, an alternate embodiment is depicted with a pair of first connector assemblies 20*a*, 20*b* each mounted on first circuit boards 11*a*, 11*b* and a pair of second connector assemblies 60*a*, 60*b* mounted on a single second circuit board 13. A satellite connector assembly 190 has a pair of satellite connectors 191*a*, 191*b* with a cable 202 extending between the two satellite connectors. One of the satellite connectors 191*a* is mounted to the second connector housing 61 of one second connector assembly 60*a* and the other satellite connector 191*b* is mounted to the second connector housing of the other connector assembly 60*b*. Because the cable 202 extends between the two satellite connectors 191*a*, 191*b*, electrical connections are made directly between the satellite connectors.

With such a configuration, an electrical connection is made from the first circuit board 11*a*, through the wafer assembly 30*a* of the second section 51 of the first connector assembly 20*a*, through the first satellite connector 191*a*, through the cable 202 to the second satellite connector 191*b*, through the wafer assembly 30*a* of the second section of the first connector assembly 20*b*, and into the first circuit board 11*b*. Through such a configuration, an electrical connection between the first circuit board 11*a* and the first circuit board 11*b* may be made without an electrical connection through the second circuit board 13.

Figure 13:
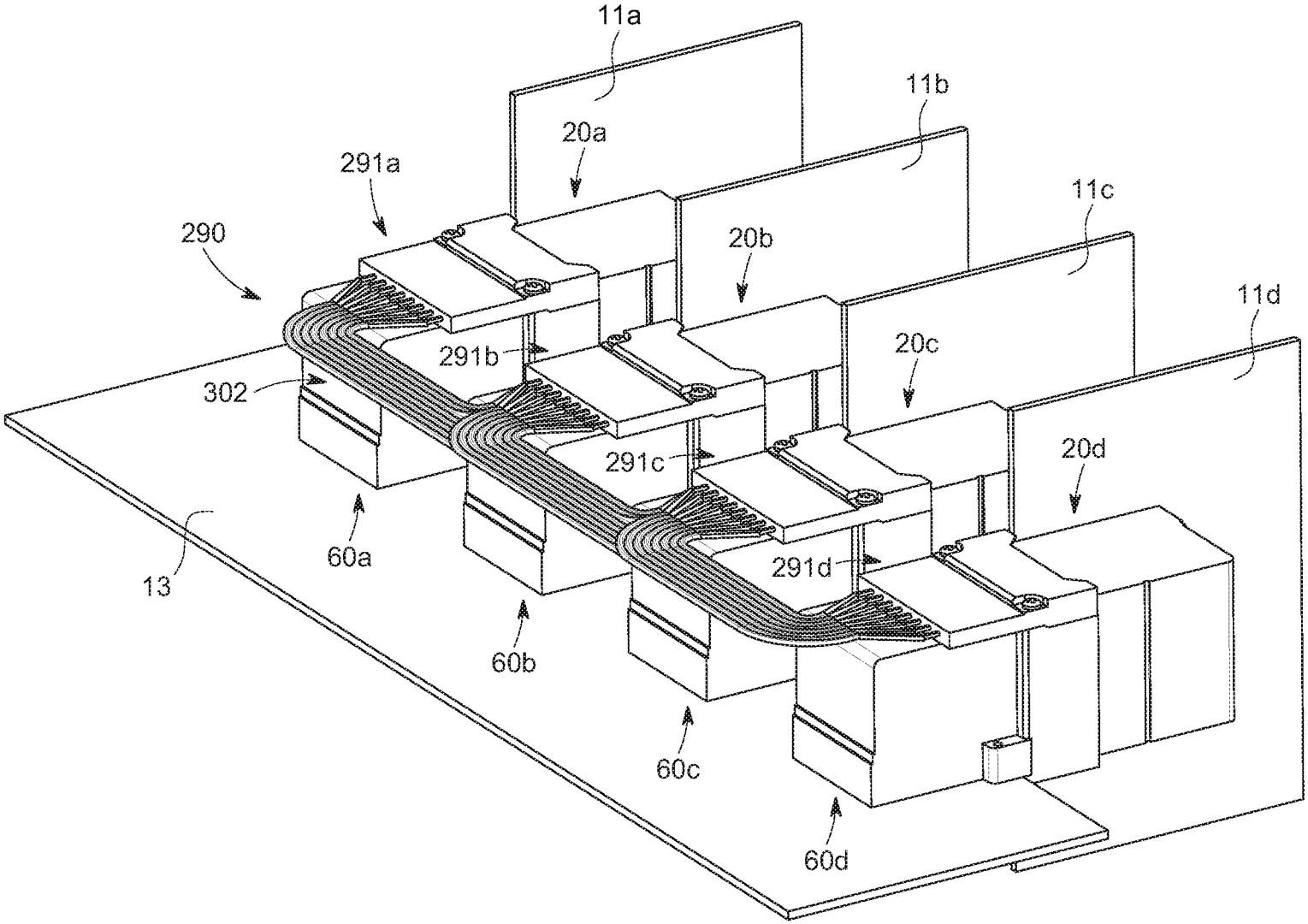
FIG. 13 is a perspective view of still another alternate embodiment of a connector system according to the disclosure.
Figure 14:
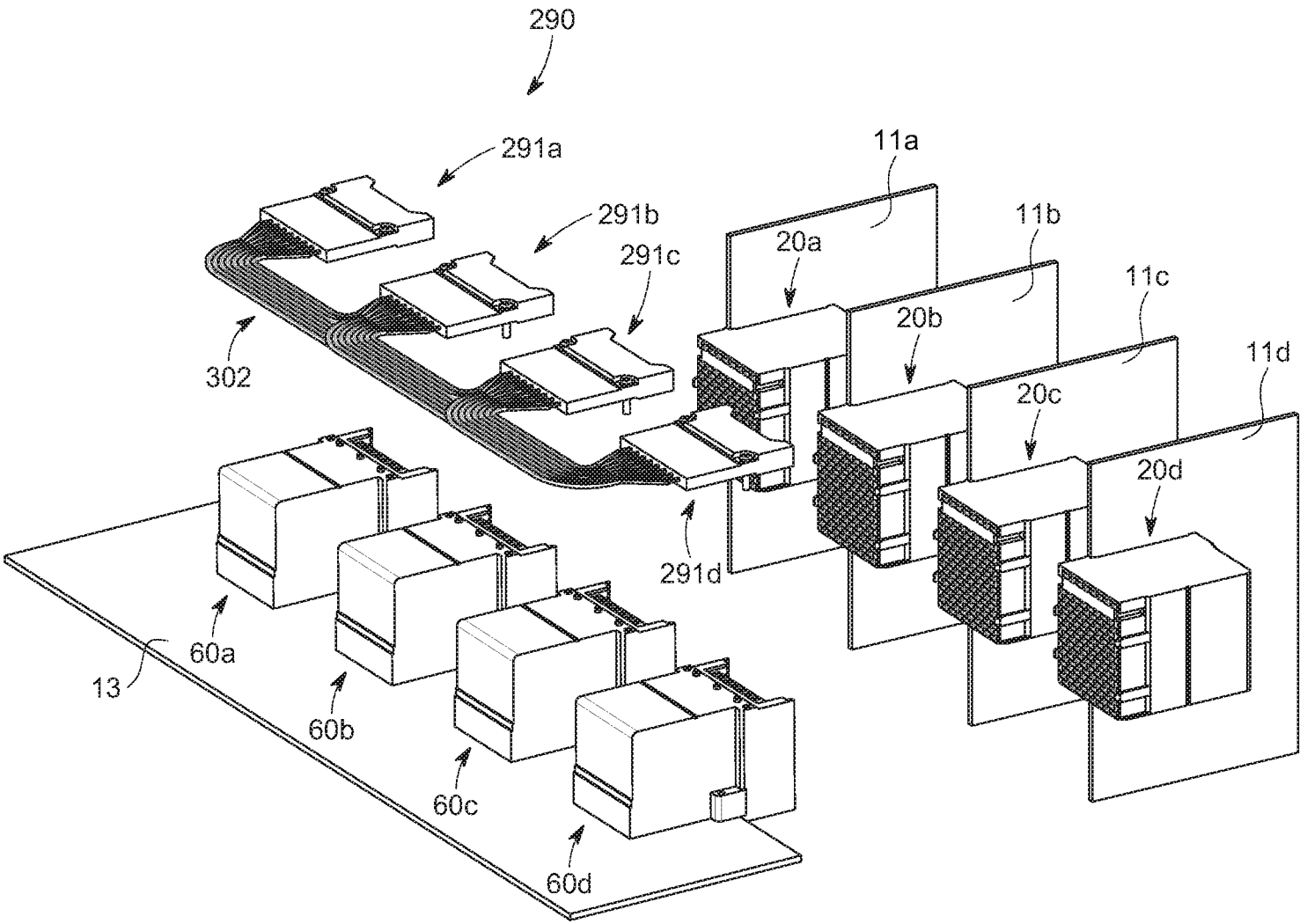
FIG. 14 is a perspective view of the connector system of FIG. 13 in an unmated condition with a satellite connector assembly exploded therefrom.

FIGS. 13-14 depict still another alternate embodiment in which a satellite connector assembly 290 includes four satellite connectors 291*a*-291*d* mounted on top of four second connector assemblies 60*a*-60*d*. The satellite connectors 291*a*-291*d* are interconnected by a cable 302 that interconnects the terminals of the satellite connectors in any desired manner. More specifically, terminals of the first satellite connector 291*a* may be connected to any of the terminals of the other satellite connectors 291*b*-291*d*, terminals of the second satellite connector 291*b* may be connected to any of the terminals of the other satellite connectors 291*a*, 291*c*-*d*, terminals of the third satellite connector 291*c* may be a connected to any of the terminals of the other satellite connectors 291*a*-*b*, 291*d*, and terminals of the fourth satellite connector 291*d* may be connected to any of the terminals of the other satellite connectors 291*a*-291*c*. The satellite cable assembly 290 is operative to connect four first circuit boards 11*a*-*d* through four first electrical connector assemblies 20*a*-20*d* mounted on each of the first circuit boards without the signals passing through the second circuit board 13.

In addition to first connector assemblies 20 having a single wafer assembly 30*a* in the second section 51 of the first housing 21 and the satellite connectors 91 having a single row of terminals, the second sections of the first connector assemblies may include a plurality of wafers 30*a* and the satellite connectors may have a plurality of rows of terminals that mate with the terminals of the wafers 30*a*. More specifically, referring to FIGS. 15-16, first connector assemblies 320*a*, 320*b* are each mounted on a first circuit board 11*a*, 11*b*. The first connector assemblies 320*a*, 320*b* may be identical to the first connector assembly 20 described above except that the first housing 321 of each first connector assembly has a larger second section 351 in which a plurality of wafer assemblies 30*a* are positioned. As depicted, the first connector assembly 320*b* has separate housing components for the first section 50 and the second section 351. Components or elements that are identical or similar to those of the first connector assembly 20 described above are identified with like reference numbers.

Satellite cable assembly 390 includes a pair of multi-row satellite connectors 391*a*, 391*b* with each multi-row satellite connector being configured to mate with one of the first connector assemblies 320*a*, 320*b*. The multi-row satellite connectors 391*a*, 391*b* may be identical or similar to the single row satellite connectors 91 described above except that they include a plurality of vertical rows of terminals above the second housing 61. In other words, the sidewalls 403 are taller than the sidewalls 97 of the satellite housing 92 to accommodate the greater number of rows of terminals supported by the satellite housing 392. Further, a plurality of rows of tails 401 extend rearwardly from the terminal retention body 393. Components or elements that are identical or similar to those of the satellite connector assembly 90 described above are identified with like reference numbers.

Figure 15:
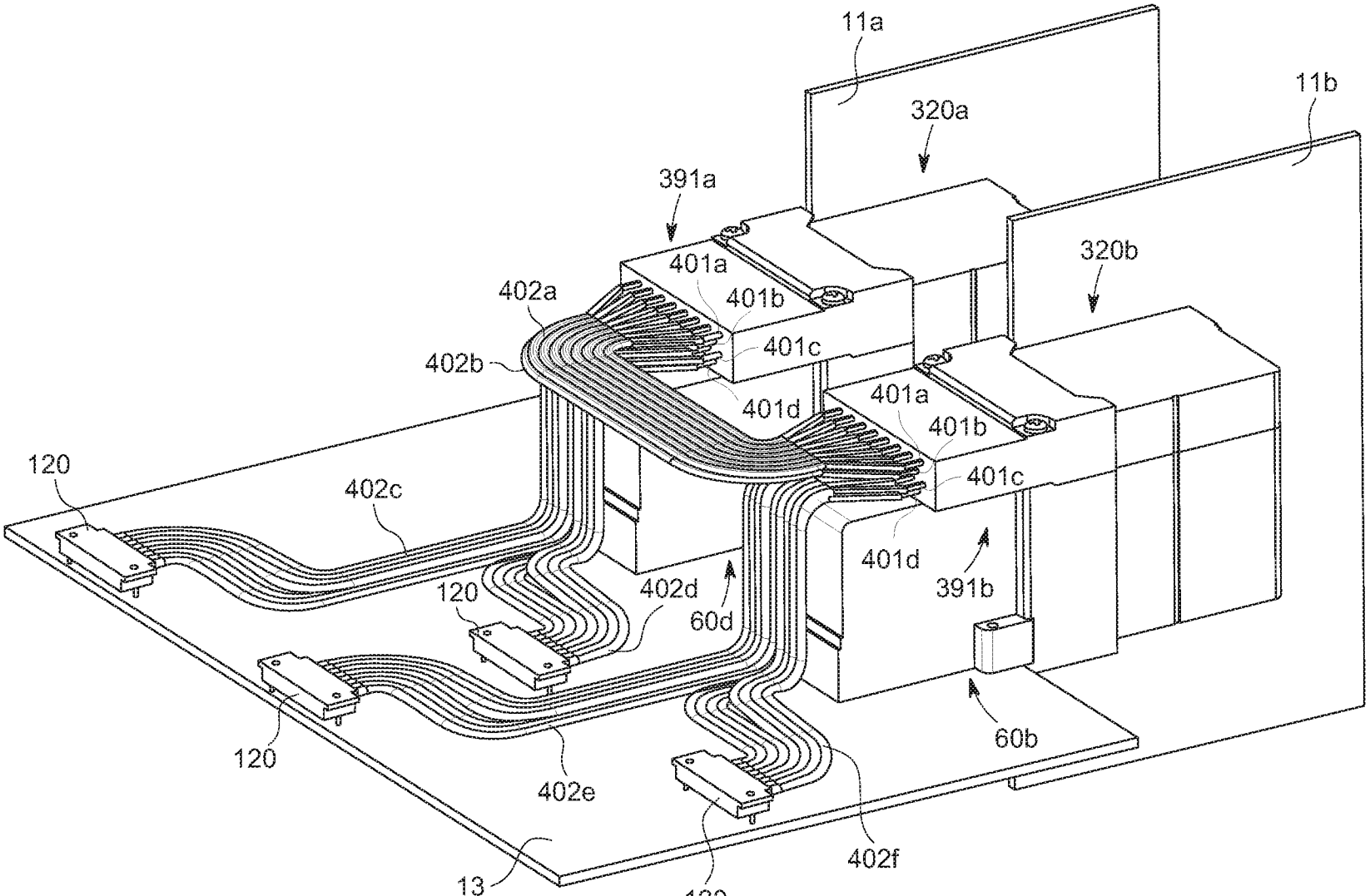
FIG. 15 is a perspective view of still another alternate embodiment of a connector system according to the disclosure.
Figure 16:
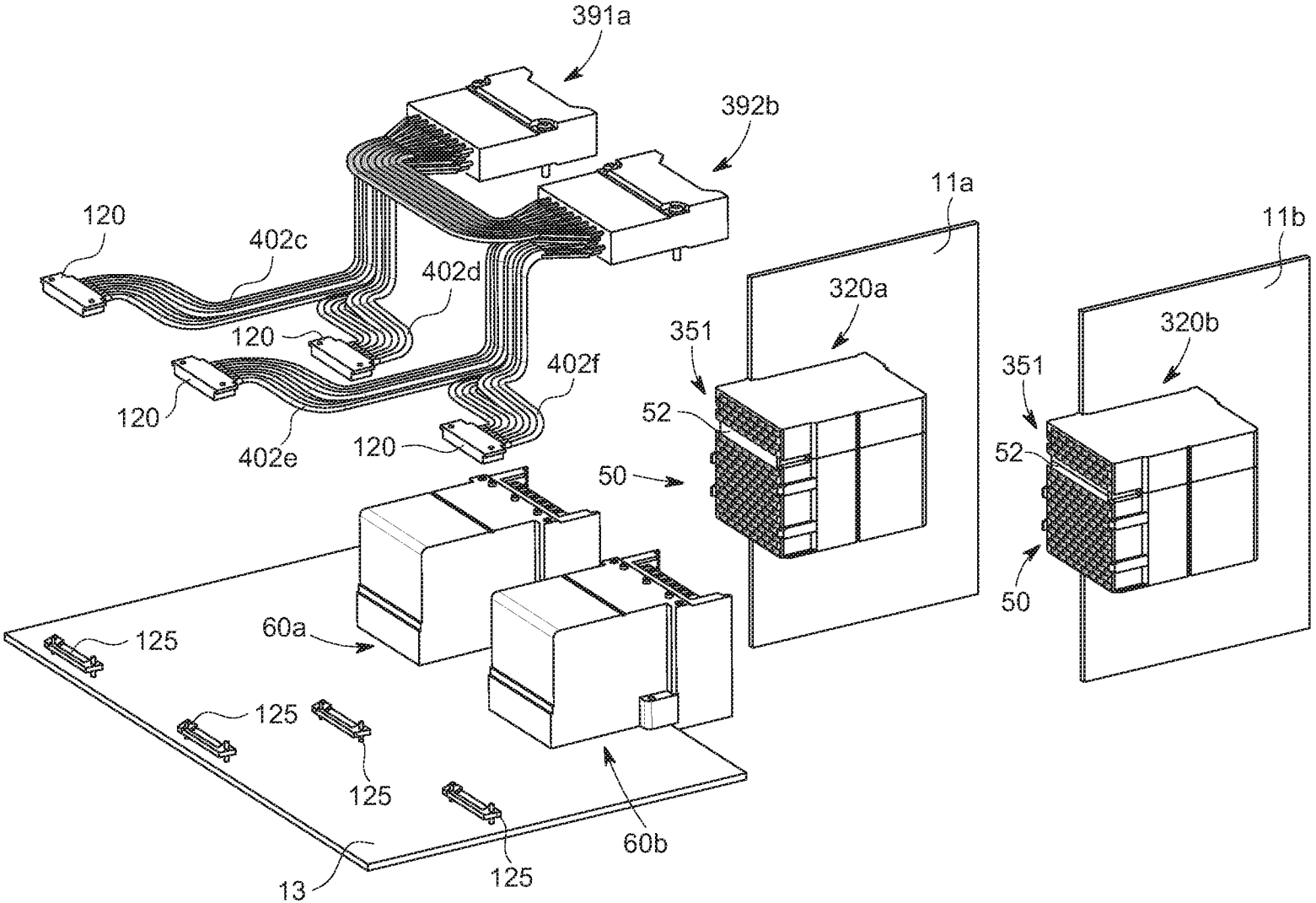
FIG. 16 is a perspective view of the connector system of FIG. 15 in an unmated condition with a satellite connector assembly exploded therefrom.

The multi-row satellite connectors 391*a*, 391*b* may be used to connect circuit boards in the manners described above with respect to either FIGS. 1-9, FIGS. 11-14, or a combination thereof. For example, as depicted in FIGS. 15-16, the upper rows of the tails 401*a*-401*b* of the two multi-row satellite connectors 391*a*, 391*b* are connected through a pair of cables 402*a*, 402*b*. As result, the end or upper (as viewed in FIGS. 15-16) wafers 30*a* can be electrically connected through the satellite cable assembly 390 without the signals passing through the second circuit board 13 as described above with respect to FIGS. 11-14. In addition, the lower rows of tails 402*c*, 402*d* of the two multi-row satellite connectors 391*a*, 391*b* are connected to board mount connectors 120 through cables 402*c*-402*f* The board mount connectors 120 are connected to board-to-board connectors (not shown) that are mechanically and electrically connected to the second circuit board 13.

Figure 17:
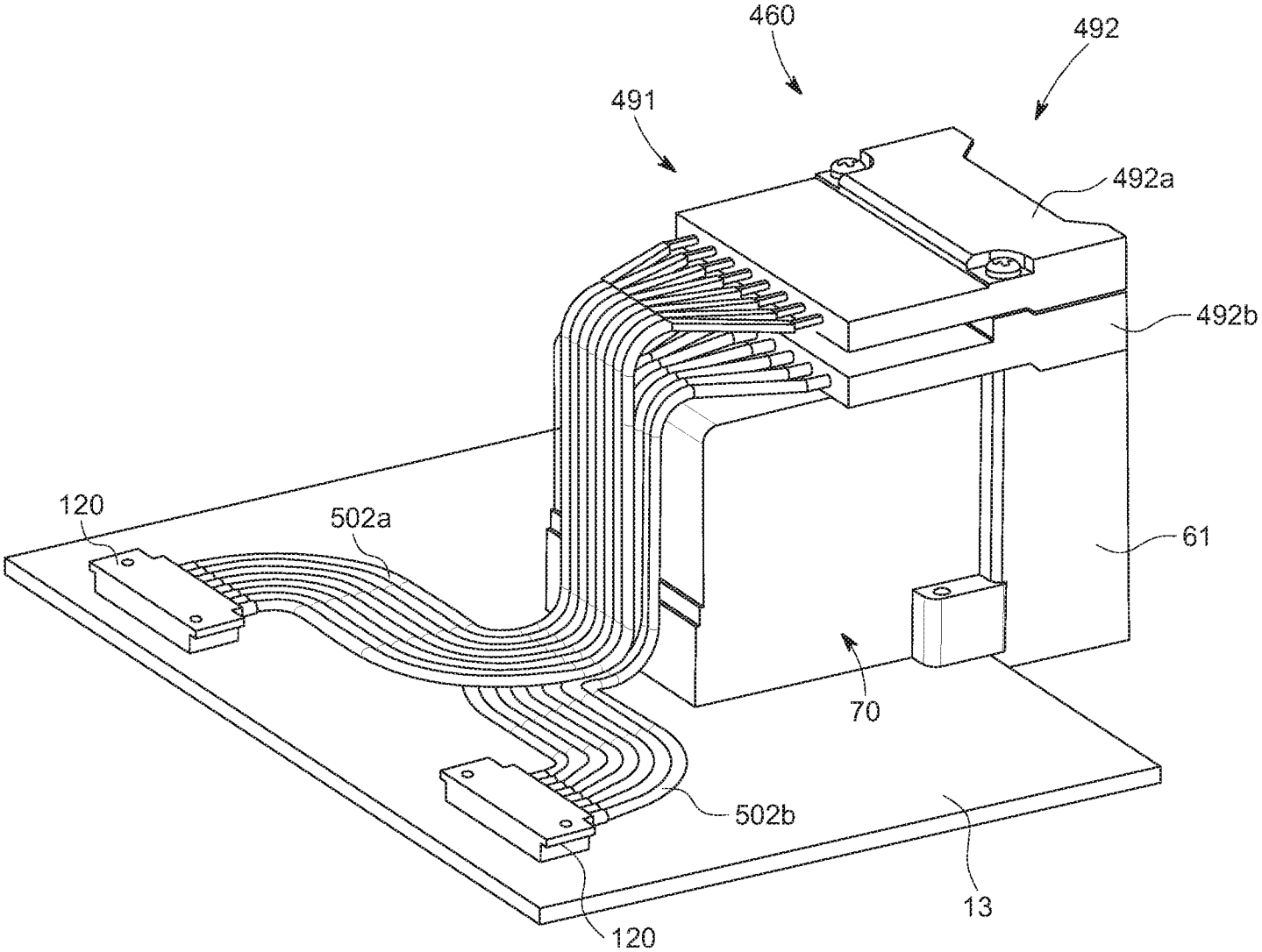
FIG. 17 is a perspective view of still another alternate embodiment of a connector system according to the disclosure.
Figure 18:
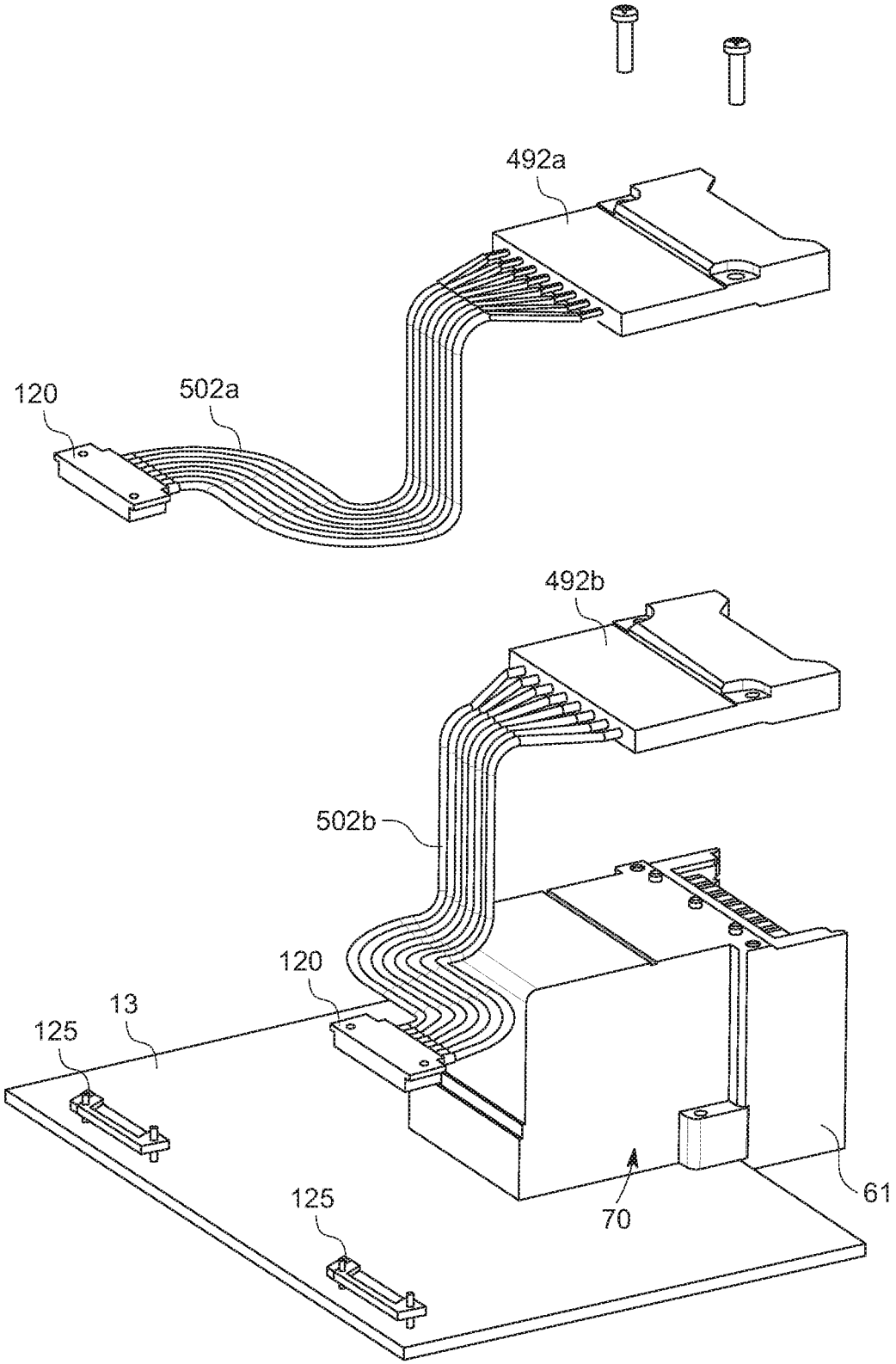
FIG. 18 is a perspective view of the connector system of FIG. 17 in an unmated condition with a satellite connector assembly exploded therefrom.
Figure 19:
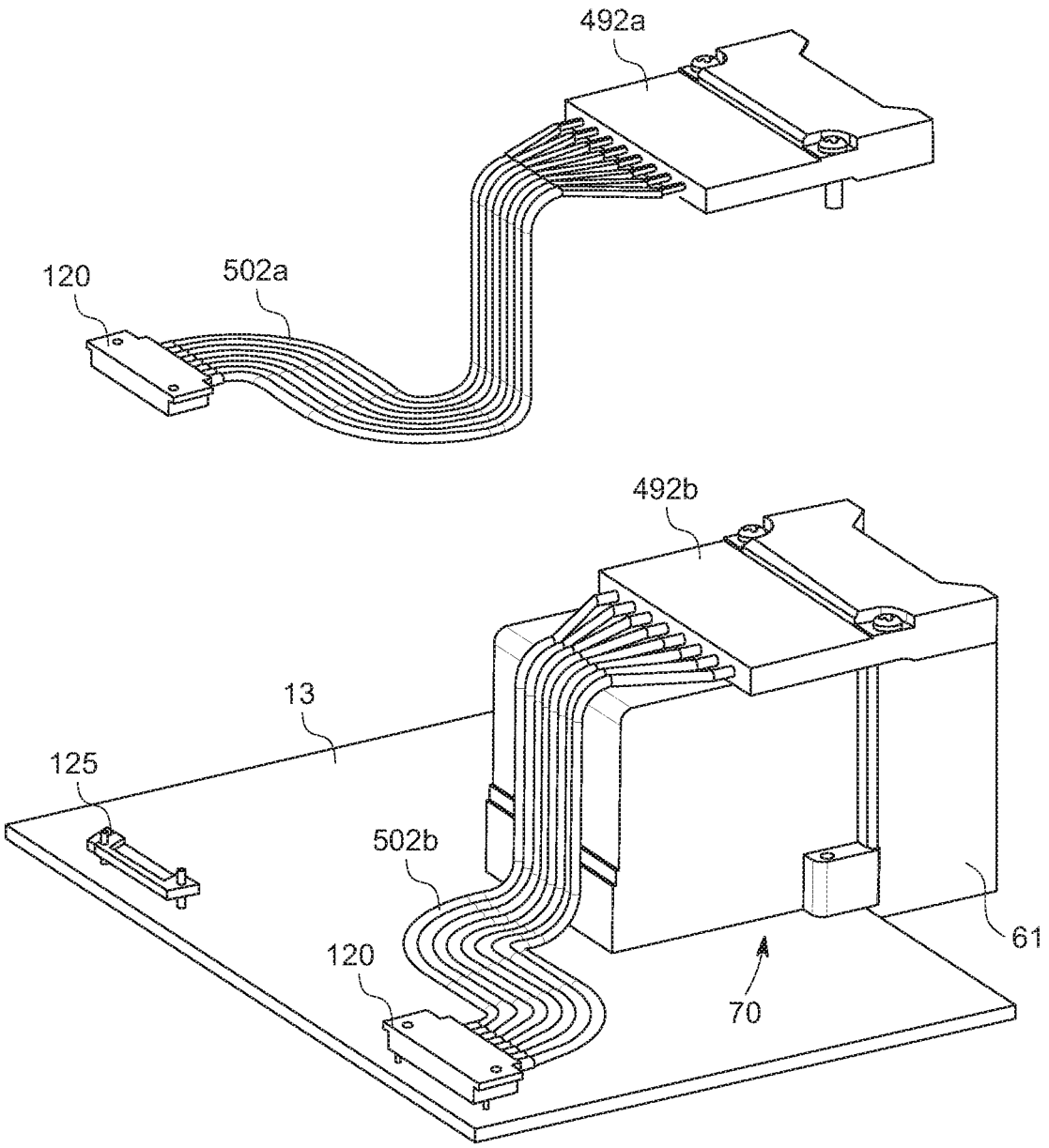
FIG. 19 is a perspective view of the connector system of FIG. 17 in an unmated condition with the satellite connector assembly partially assembled.

In another example depicted in FIGS. 17-19, a second connector assembly 490 may include a multi-row satellite connector 491 formed with a multi-component housing 492. In the depicted example, the housing 492 is formed of two or more housing components 492*a*, 492*b*, each having terminals secured therein. The terminals may be terminated to cables 502*a*, 502*b* having board mount connectors 120 connected thereto or may be terminated to cables (not shown) that are terminated to other housing components of adjacent second connector assemblies.

Figure 20:
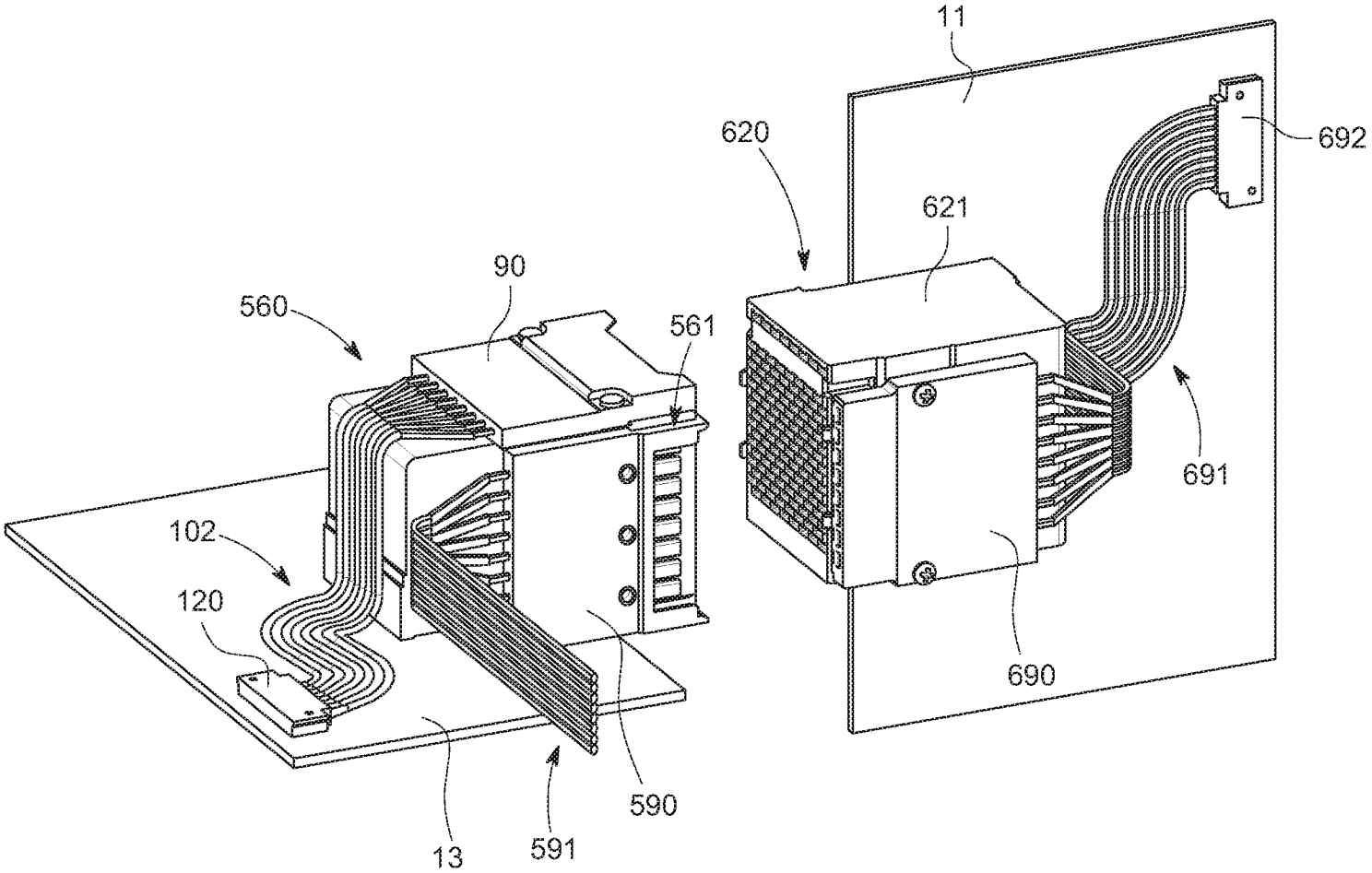
FIG. 20 is a perspective view similar to FIG. 2 but with an additional pair of mating satellite connectors mounted on the housings.

FIG. 20 is a perspective view similar to FIG. 2 but with an additional pair of mating satellite connectors 590, 690 mounted on the housings. This additional pair of satellite connectors 590, 690 have terminals and housings that are configured to be mated together.

Although FIGS. 1-9 depict the wafer assembly 30*a* and the satellite connector assembly 90 as each having an array of high speed signal terminals and ground members similar or identical to those of wafers assemblies 30, 70, respectively, alternative configurations are contemplated. The second section 51 of the first housing 21 may include or make any type of connection including power terminals, optical fiber connectors, and low speed signals terminals, as well as high speed signal terminals and ground members similar to those depicted in FIGS. 1-5. In some instances, the connections within second section 51 may not be mounted within a wafer assembly or at least a wafer assembly similar to the wafer assemblies 30, 30*a*. The satellite connector assembly 90 is configured with connections that will mate with those of the second section 51. As an example, Referring back to FIG. 10, the wafer assembly 30*a* and the satellite connector assembly 90 are each depicted as having two power terminals 110, two optical fiber connectors 111, and two pairs of high speed terminals 112 with ground members 113 between the high speed connections and on the ends thereof.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context. Still further, the advantages described herein may not be applicable to all embodiments encompassed by the claims.

The invention claimed is:

1. An electrical connector assembly comprising:

a housing member, the housing member having a plurality of outer surfaces;

a plurality of wafers supported by the housing member, each wafer including a plurality of electrically conductive terminals and an insulative support member supporting the electrical terminals, each terminal having a contact configured to electrically connect the terminal to another electrical component; and a satellite connector disposed along one of the outer surfaces of the housing member, the satellite connector including an insulative satellite housing and a plurality of connections supported by the satellite housing, each connection having a termination section, the termination section being operatively connected to a cable.

2. The electrical connector assembly of claim 1, wherein the wafers are parallel and oriented in a first direction and the plurality of connections of the satellite connector lie in a plane oriented perpendicular to the plurality of wafers.

3. The electrical connector assembly of claim 1, wherein the connections of the satellite connector comprise electrically conductive terminals.

4. The electrical connector assembly of claim 3, wherein the termination sections of the connections are disposed along a rear surface of the satellite housing.

5. The electrical connector assembly of claim 1, wherein the termination sections of the connections of the satellite connector are terminated to a conductive member.

6. The electrical connector assembly of claim 5, wherein the conductive member is a cable having a plurality of electrically conductive wires, each wire being terminated to the termination section of one of the connections.

7. The electrical connector assembly of claim 5, wherein the conductive member is a flexible circuit member having a plurality of electrical conductors, each conductor being terminated to the termination section of one of the terminals.

8. The electrical connector assembly of claim 1, wherein the wafers are generally planar and oriented in a side-by-side relationship and the satellite housing of the satellite connector is generally planar, the planes of the wafers being transverse to the plane of the satellite housing.

9. The electrical connector assembly of claim 8, wherein the housing member includes first and second spaced apart sidewalls, and the wafers are parallel to the sidewalls.

10. The electrical connector assembly of claim 9, wherein the plurality of wafers define a sub-assembly having a first end and an opposite second end, the first end being disposed adjacent the first side wall and the second end being adjacent the second sidewall.

11. The electrical connector assembly of claim 1, wherein the wafers are disposed within the housing member.

12. The electrical connector assembly of claim 1, wherein the satellite housing is a separate component from the housing.

13. The electrical connector assembly of claim 1, wherein the wafers include a plurality of high speed signal terminals and a plurality of ground members.

14. The electrical connector assembly of claim 1, wherein the terminals of the wafers include a mating section along a mating face and tails of the terminals are disposed along a board mount face, the mating face being perpendicular to the board mount face.

15. The electrical connector assembly of claim 14, wherein the tails of the terminals comprise press fit pins.

16. The electrical connector assembly of claim 1, wherein a portion of the housing member and a portion of the satellite housing define a shroud surrounding a mating section of the terminals of the wafers, the shroud being configured to operatively receive a mating electrical connector.

17. The electrical connector assembly of claim 16, wherein the portion of the satellite housing defines an upper portion of the shroud.

18. The electrical connector assembly of claim 1, wherein the connections of the satellite connector comprise at least one power terminal.

19. The electrical connector assembly of claim 1, wherein the connections of the satellite connector comprise at least one optical fiber connector.

20. The electrical connector assembly of claim 1, wherein the connections of the satellite connector comprise a plurality of high speed signal terminals and a plurality of ground members.

21. The electrical connector assembly of claim 1, wherein the connections of the satellite connector comprise at least one electrically conductive low speed signal terminal.

22. The electrical connector assembly of claim 1, further comprising:

a second electrical connector assembly having a second housing member including a plurality of outer surfaces, a plurality of second wafers supported by the housing member, each wafer including a plurality of electrically conductive terminals and an insulative support member supporting the electrical terminals, each terminal having a contact configured to electrically connect the terminal to another electrical component; and a second satellite connector disposed along one of the outer surfaces of the second housing member, the second satellite connector including an insulative second satellite housing and a plurality of connections supported by the second satellite housing, each connection having a termination section, the termination section being operatively connected to the cable from the first satellite connector.

23. The electrical connector assembly of claim 1, wherein the housing member has an upper surface, each terminal further has a tail configured to electrically connect the terminal to a circuit member, the tail of each terminal being disposed along a lower surface of the electrical connector, the upper surface being opposite the lower surface, and the satellite connector being disposed along the upper surface of the housing member.

* * * * *